US008584271B2

(12) United States Patent
Mathis et al.

(10) Patent No.: US 8,584,271 B2
(45) Date of Patent: Nov. 19, 2013

(54) CORNER PLATE FOR HOLDING A POOL LINER

(75) Inventors: Wesley L. Mathis, West Jordan, UT (US); David B. Dalton, Heber City, UT (US)

(73) Assignee: Pool Cover Specialists National, Inc., West Jordan, UT (US)

( * ) Notice: Subject to any disclaimer, the term of this patent is extended or adjusted under 35 U.S.C. 154(b) by 1045 days.

(21) Appl. No.: 12/335,535

(22) Filed: Dec. 15, 2008

(65) Prior Publication Data

US 2009/0151067 A1 Jun. 18, 2009

Related U.S. Application Data

(60) Provisional application No. 61/007,789, filed on Dec. 13, 2007.

(51) Int. Cl.
*E04H 4/14* (2006.01)
*E02D 27/00* (2006.01)

(52) U.S. Cl.
USPC ..... 4/506; 4/496; 4/503; 52/169.7; 52/287.1

(58) Field of Classification Search
USPC ..... 4/488–489, 496–499, 503, 506–508; 52/85, 169.7, 287.1, 204.2, 204.57, 52/312, 656.1, 656.2, 716.2–716.4
See application file for complete search history.

(56) References Cited

U.S. PATENT DOCUMENTS 1,782,147 A 11/1930 Merryweather
2,442,929 A 6/1948 Marino
3,008,273 A 11/1961 Widin
3,220,633 A * 11/1965 Swane ..... 229/198.1
3,315,639 A * 4/1967 Close ..... 118/642
3,440,780 A * 4/1969 West et al. ..... 52/169.7
3,524,291 A 8/1970 Rozanski
3,835,481 A 9/1974 Engelhart et al.
3,950,907 A 4/1976 Dahowski
3,967,422 A 7/1976 Stegmeier
3,974,605 A 8/1976 Beatty et al.
3,986,309 A 10/1976 Coulter
4,008,547 A 2/1977 Katzman
4,086,739 A 5/1978 Hall
4,167,084 A 9/1979 Brunton
4,205,486 A * 6/1980 Guarnacci ..... 49/501
4,297,819 A 11/1981 Arp
4,457,119 A 7/1984 Dahowski
4,459,119 A 7/1984 Beijer
4,459,711 A 7/1984 Sartain et al.
4,601,073 A 7/1986 Methot
4,603,521 A 8/1986 Engelhart
4,665,666 A 5/1987 Hampton
4,765,775 A 8/1988 Kroger
4,811,433 A 3/1989 MacDonald et al.

(Continued)

OTHER PUBLICATIONS

Foxxx Installation Manual 1 for Pool & Reel Box SA-938, Aug. 1, 2000, 32 pages.

(Continued)

*Primary Examiner* — Winnie Yip

(74) *Attorney, Agent, or Firm* — Clayton, Howarth & Cannon, P.C.

(57) ABSTRACT

A corner for a pool providing a transition of the corner angle therein and thereby providing for ease of installation, improved aesthetics, improved operation, and simpler maintenance.

15 Claims, 23 Drawing Sheets

(56) References Cited

U.S. PATENT DOCUMENTS

| | | | | | |
|---|---|---|---|---|---|
| 4,939,798 | A | | 7/1990 | Last | |
| 4,955,092 | A | | 9/1990 | Hagan | |
| 5,044,022 | A | | 9/1991 | Hess | |
| 5,092,090 | A | | 3/1992 | Stump | |
| 5,134,730 | A | | 8/1992 | Vandis | |
| 5,134,819 | A | | 8/1992 | Boyack | |
| 5,333,428 | A | | 8/1994 | Taylor et al. | |
| 5,454,195 | A | | 10/1995 | Hallsten | |
| 5,488,745 | A | | 2/1996 | Barrera | |
| 5,524,399 | A | | 6/1996 | Reum et al. | |
| 5,555,574 | A | | 9/1996 | Wason et al. | |
| 5,560,178 | A | * | 10/1996 | Dahowski et al. | 52/741.3 |
| 5,572,834 | A | | 11/1996 | Lilly | |
| 5,680,730 | A | | 10/1997 | Epple | |
| 5,819,485 | A | | 10/1998 | Lane et al. | |
| D404,145 | S | | 1/1999 | Fisher | |
| 5,890,240 | A | | 4/1999 | Graham | |
| 5,913,613 | A | | 6/1999 | Ragsdale et al. | |
| 5,916,099 | A | | 6/1999 | Hall | |
| 5,920,922 | A | | 7/1999 | Ragsdale et al. | |
| 5,947,437 | A | * | 9/1999 | Tate et al. | 248/467 |
| 6,014,778 | A | | 1/2000 | Varnado | |
| D428,804 | S | * | 8/2000 | Benz et al. | D8/382 |
| 6,128,864 | A | | 10/2000 | Barry et al. | |
| 6,195,945 | B1 | | 3/2001 | McGarry et al. | |
| 6,324,706 | B1 | | 12/2001 | Epple | |
| 6,357,058 | B1 | | 3/2002 | Biancamano | |
| 6,389,757 | B1 | | 5/2002 | DeGarie | |
| 6,390,680 | B1 | | 5/2002 | Last | |
| 6,418,572 | B1 | | 7/2002 | Epple et al. | |
| 6,457,189 | B1 | | 10/2002 | Kindness | |
| 6,496,990 | B2 | | 12/2002 | Last | |
| 6,662,383 | B2 | | 12/2003 | Cornelius et al. | |
| 7,114,297 | B2 | * | 10/2006 | Mathis et al. | 52/169.7 |
| 7,707,795 | B2 | * | 5/2010 | Yu et al. | 52/657 |
| 2001/0047540 | A1 | | 12/2001 | Perrier | |
| 2003/0084619 | A1 | | 5/2003 | Smith | |
| 2003/0097709 | A1 | | 5/2003 | Smith | |
| 2003/0131556 | A1 | | 7/2003 | Breslin et al. | |
| 2003/0145373 | A1 | | 8/2003 | Mathias | |
| 2003/0190192 | A1 | | 10/2003 | Cain et al. | |
| 2003/0213195 | A1 | | 11/2003 | Mathis et al. | |

OTHER PUBLICATIONS

Sentry Pool, Inc., Products & Accessories, printed from www.sentrypoo.com/html/accessories.html, Jul. 26, 2001, 3 pages.

Wardell, Randy and Judy, Introduction to Stained Glass: A Teaching Manual, 1985, Wardell Publications, Houston, Texas, 40 pages.

* cited by examiner

CORNER PLATE FOR HOLDING A POOL LINER

CROSS-REFERENCE TO RELATED APPLICATIONS

This application claims the benefit of U.S. Provisional Application Ser. No. 61/007,789, filed Dec. 13, 2007, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND OF THE INVENTION

1. The Field of the Invention

The invention relates generally to swimming pool features, and more particularly, but not necessarily entirely, to a corner plate for use in the construction of a swimming pool.

2. Description of Related Art

Swimming pools can be formed to have a variety of different configurations. One known variety of swimming pool includes a sidewall covered with a liner attachment. An upper, free end of the liner is received in a circumferential liner slot located near the top of the pool which extends entirely around the pool's perimeter. It is common practice to form the swimming pools in various shapes to enhance the aesthetic and functional aspects of the pool. For example, some swimming pools have side walls that meet in ninety degree corners, whereas other swimming pools have corners that meet at other angles to present a better aesthetic appearance to some observers than the ninety degree corners.

Swimming pool designers have had difficulties in designing liner-pools with corners in an economic manner that function properly and have a pleasant appearance. For example, corner pieces have previously been installed in swimming pools between adjacent pool sides to achieve corners. However, it has been difficult to match and align the liner slot on the adjacent sides of the swimming pool adequately. The corner pieces added to swimming pools have been known to create gaps between the corner piece and the sidewalls which detract from the appearance of the corner.

Referring now to FIG. 1, a view of a swimming pool, indicated generally at 1, is shown having corners. The swimming pool 1 will typically include sidewalls 4 covered with a coping 6 defining the perimeter of the pool 1. The pool 1 will typically also include a retractable pool cover 8 which precludes the collection of debris and leaves in the swimming pool 1. This helps reduce the frequency and amount of pool maintenance which would otherwise be required. In addition, the retractable pool cover 8 may provide a significant safety benefit in that the weight of a person may be supported by the pool cover 8 while the pool cover 8 is extended over the water, to prevent unwanted access to the pool 1 or drowning while the pool 1 is unattended. Furthermore, the retractable pool cover 8 may be beneficial in reducing heat loss and actually increasing water temperature through solar heating. The corner 2 of the is configured to be compatible with the pool cover 8 to provide a more attractive and finished appearance. Liner pools using a polymeric liner that is attached at the side coping 6, typically use thick retainer portions circumnavigating the liner for attaching the liner to the coping 6. Attaching said retainer portion at corner junctions has proven challenging. It will be appreciated that pools of various sizes and configurations may be used within the scope of the embodiment.

In view of the drawbacks inherent in the available art, it would be a significant advance in the art to provide a corner with a liner receiving channel for use in constructing corners of a swimming pool, that is simple in design and manufacture, and which provides a finish cover with an aesthetically pleasant appearance. Additionally, design elements and manufacturing costs may demand a more economical or more athletically pleasing pool corner than a rounded corner. For example during assembly of a swimming pool at a client site, the corner of the pool may not align at substantially a tangential relationship with the pool side coping members. A Strictly rounded corner plate may not be readily adjustable to the situation due to the fact that tangentionally cutting or trimming a curve greatly reduces the corresponding dimension of the trimmed side. As can be seen in FIG. 2, such a misalignment is illustrated. A pool corner 100 having a misalignment between side coping member 114 and corner piece 110 may result in the need to remove a substantial length 'L' of the corner piece 110, and can result in a much less tangential relationship between the side coping 114 corresponding to the trimmed side 110*a* of the corner piece 110 at the junction 126*a*. The mis-alignment is illustrated with the dashed line 114*a* and would dictate a coroner junction at 124*a* instead of the position shown at 124. Correction in the field can pose problems with tools, coatings on the part and other shortfalls to be discussed below with reference to the disclosure. These short falls or complications can cost in money, time, and appearance in the final product.

The prior art is thus characterized by several disadvantages that are addressed by disclosure herein. The embodiments disclosed herein minimizes, and in some aspects eliminates, the above-mentioned failures, and other problems, by utilizing the methods and structural features described herein.

SUMMARY OF THE DISCLOSURE

What is needed is a pool corner piece that provides a transition in a pool corner that offers greater flexibility in the field while being installed. What is needed is a pool corner piece that provides aesthetic variations for users. Such an apparatus is disclosed herein.

What is needed is a system for a pool that provides a transition in a pool corner or corners thereof, that offer greater flexibility in the field while being installed and that provides aesthetic variations for users. Such a system is disclosed herein.

What is needed is a method for installing a pool that provides a transition in a pool corner or corners thereof, that offer greater flexibility in the field while being installed, and that provides aesthetic variations for users. Such a method is disclosed herein.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
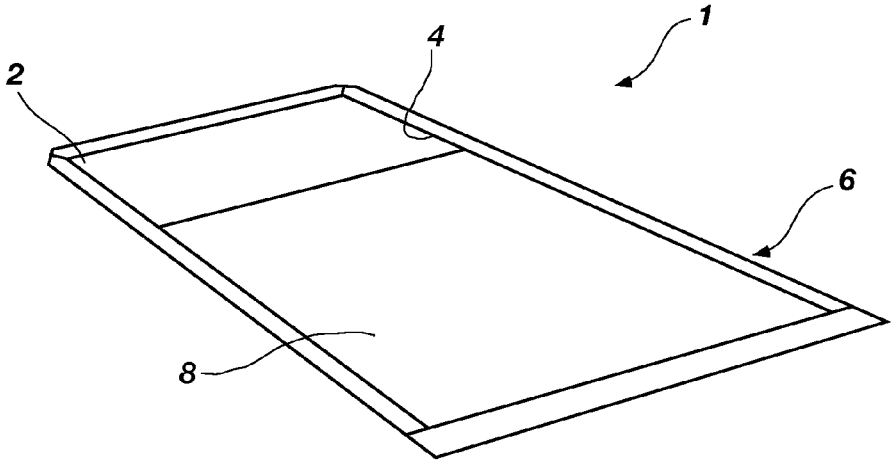
FIG. 1 (PRIOR ART)
FIG. 1 is a view of a prior art swimming pool including a corner.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

The publications and other reference materials referred to herein to describe the background of the disclosure, and to provide additional detail regarding its practice, are hereby incorporated by reference herein in their entireties, with the following exception: In the event that any portion of said reference materials is inconsistent with this application, this application supercedes said reference materials. The reference materials discussed herein are provided solely for their disclosure prior to the filing date of the present application. Nothing herein is to be construed as a suggestion or admission that the inventors are not entitled to antedate such disclosure by virtue of prior disclosure, or to distinguish the present disclosure from the subject matter disclosed in the reference materials.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

Figure 2:
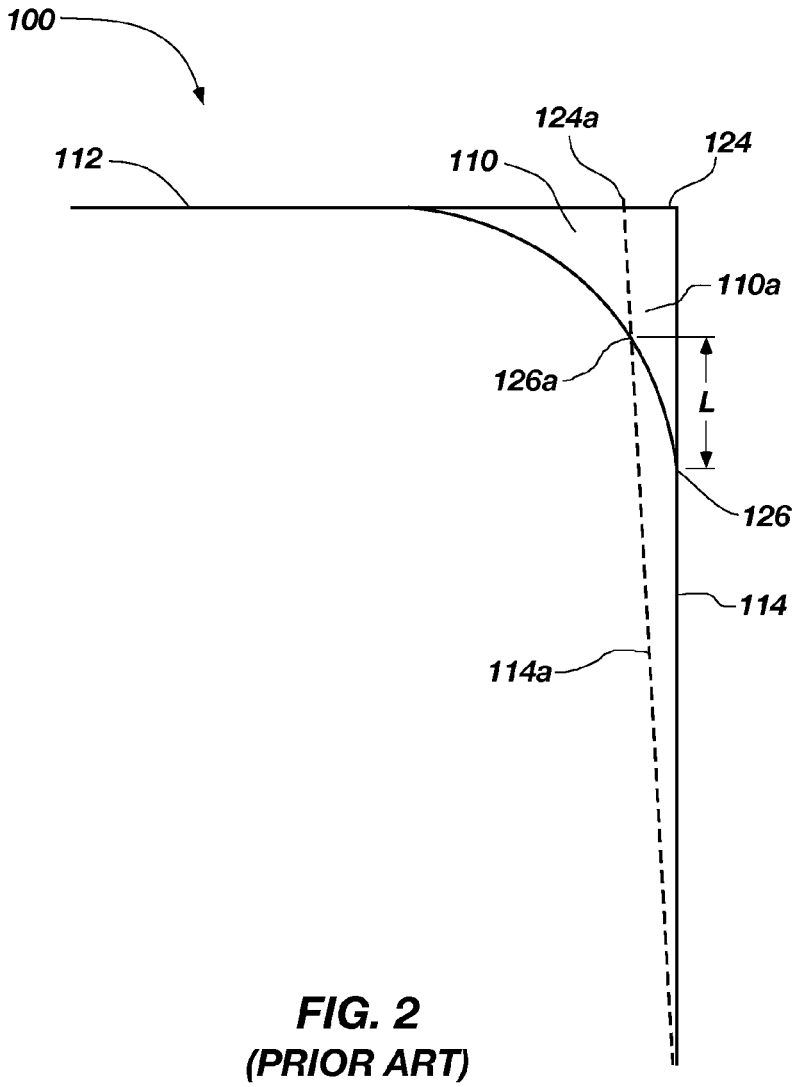
FIG. 2 (PRIOR ART)
FIG. 2 is a view of a prior art swimming pool corner of the prior art that illustrates the effect of misalignment.
Figure 3:
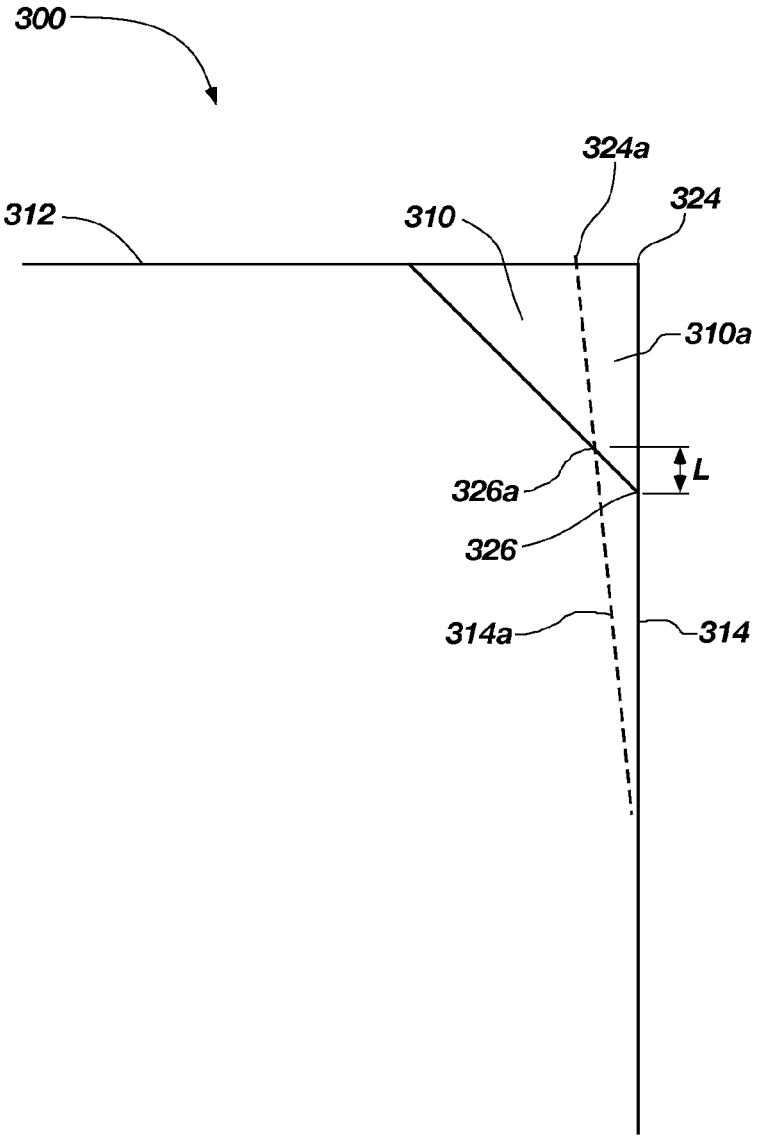
FIG. 3 is a view of an exemplary embodiment of a corner piece illustrating alignment correction.

Referring now to FIG. 3 a transitional corner piece will be discussed that provides simple field adjustment. During assembly of a swimming pool at a client site, the corner of the pool may not align at substantially a tangential relationship to pool side coping members 312,314. A Strictly rounded corner plate may not be readily adjustable to the situation due to the fact that tangentially cutting or trimming a curve greatly reduces the corresponding dimension of the trimmed side. As can be seen in FIG. 1. However with a chopped or other configuration with transitional angles the situation can be corrected with a simple miter cut. A pool corner 300 having a mis-alignment between side coping member 314 and corner piece 310 may result in the need to remove substantially less material from the corner piece as seen by length 'L" of the corner piece 310. Compare the length 'L" of FIG. 3 to 'L' of FIG. 2 and it is apparent that angular transitional corners remove less material for the same alignment adjustment. Such an adjustment can result in a much improved tangential relationship between the side coping 314 and corresponding trimmed side 310*a* of the corner piece 310 at the junction 326*a*. The mis-alignment is illustrated with the dashed line 314*a* and would dictate a corner junction at 324*a* instead of the intended position shown at 324. Simple tools and measurements can be used with such an angled corner plate 310.

Figure 4:
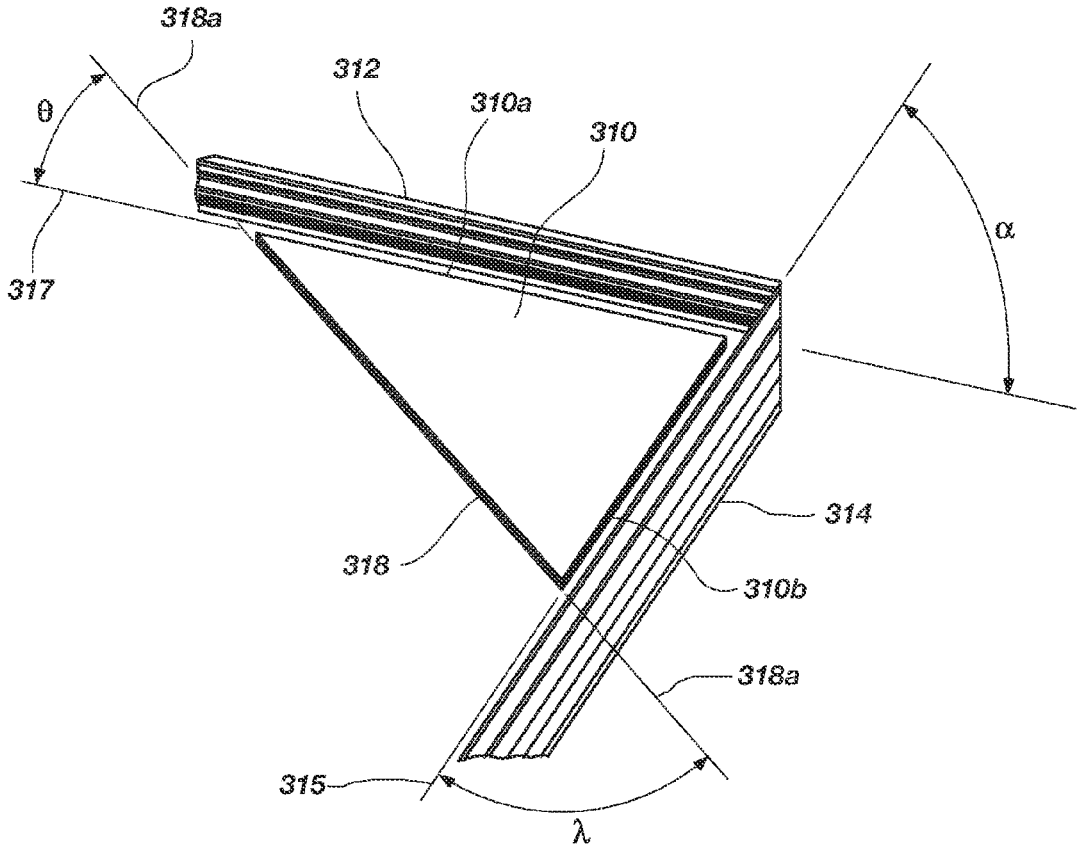
FIG. 4 is a view of an exemplary embodiment of a corner piece and other components.

Referring now to FIG. 4, a view of an exemplary embodiment of the corner 300 is shown. The corner 310 may include two lengths of coping 314 and 312 which may meet to form a corner of a pool. In the embodiment, the corner is a ninety degree corner, however it will be appreciated that other angular relationships for pool corners conform to, and are contemplated within, the scope of the patent, including, but not limited to, a corner defining any angle greater than zero degrees or less than 180 degrees. As illustrated corner piece 310 provides a two angle transition of the liner receptor portion 318 in the 90 degree corner 300. The angles are most readily observed by extending tangent lines 315, 317 from the coping members 312, 314 and tangent line 318*a* from the liner receptor portion 318 and then measuring the angular relationship between those tangent lines. For example an embodiment would include a pool would have a 45 degree angle θ and a 45 degree angle λ. Other angular configurations are within the scope of this disclosure. It should be noted that the angles between the coping members and the corner piece are most likely to be acute angles to provide a smooth transition for the liner receptor slot therein.

Figure 5:
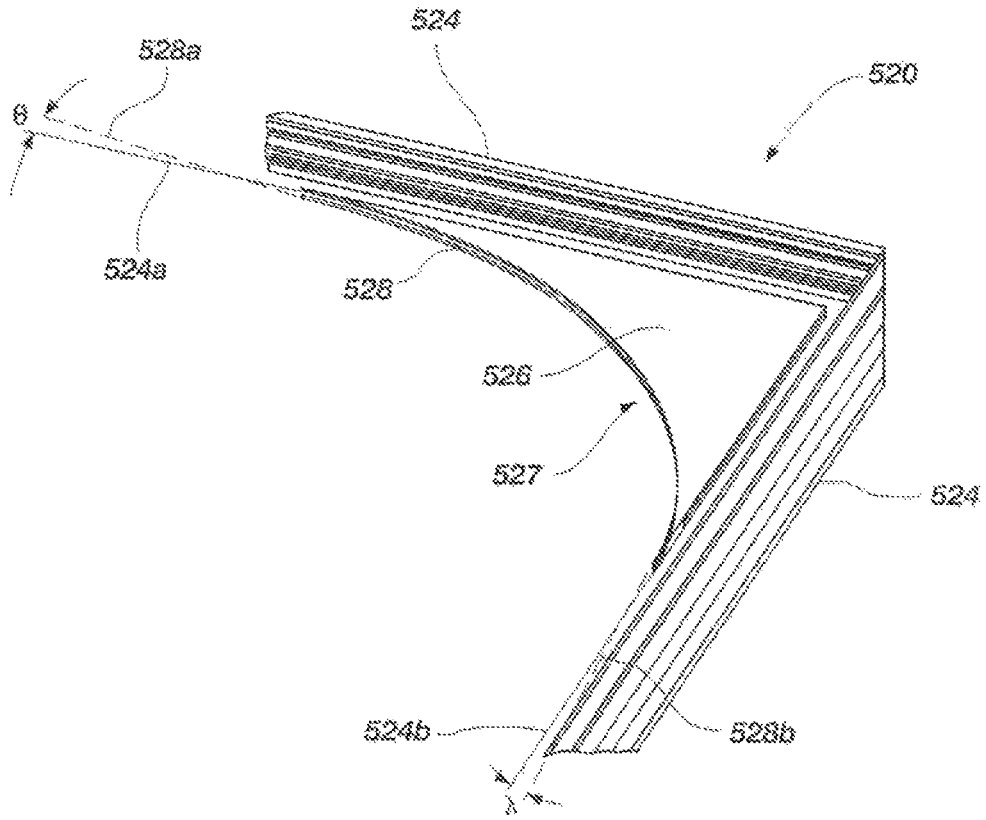
FIG. 5 is a view of an exemplary embodiment of a corner piece and other components.
Figure 6:
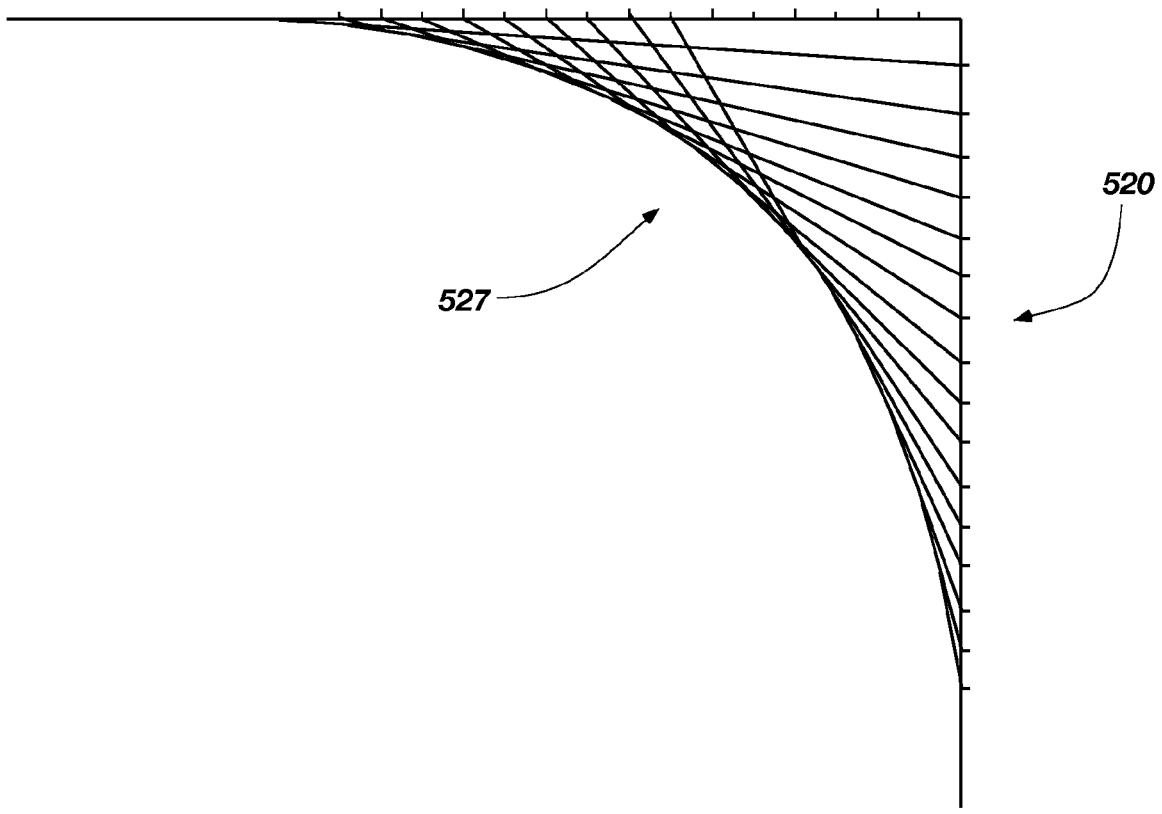
FIG. 6 is a view of an exemplary embodiment of a corner of FIG. 5.

Referring now to FIG. 5, a view of an exemplary embodiment of a corner 520 is shown. The corner 520 may include two lengths of coping 524 which may meet to form a corner 520 of a pool. In the embodiment, the corner is a ninety degree corner, however it will be appreciated that other angular relationships for pool corners conform to, and are contemplated within, the scope of the patent, including, but not limited to, a corner defining any angle greater than zero degrees or less than 180 degrees are contemplated within the scope of the patent. As illustrated corner piece 526 provides a smooth rounded corner transition of 90 degrees for corner 520. As seen in FIG. 6 a theoretical infinite number of angles makes a smooth rounded transition of the liner receptor portion 527. The angles between the corner peace 526 and coping members 524 are most readily observed by extending tangent lines 528*a*, 528*b*, 524*a*, 524*b* from the coping members 524 and from the liner receptor portion 528 and then measuring the angular relationship between those tangent lines. For example a pool of this embodiment may have a very small degree angle θ and a very small degree angle λ because of the rounded transition. The first and second acute angles can be understood to be approaching smaller and smaller angles until the angle transitions are approximating zero degrees each. The same reasoning would be employed to find the angle λ. Other angular configurations are within the scope of this disclosure. It should be noted that the angles between the coping members and the corner piece are most likely to be acute angles to provide a smooth transition for the liner receptor slot therein. In an embodiment, the corner is a ninety degree corner, however it will be appreciated that the other angular relationships for pool corners conform to, and are contemplated by, the scope of the patent.

Figure 7:
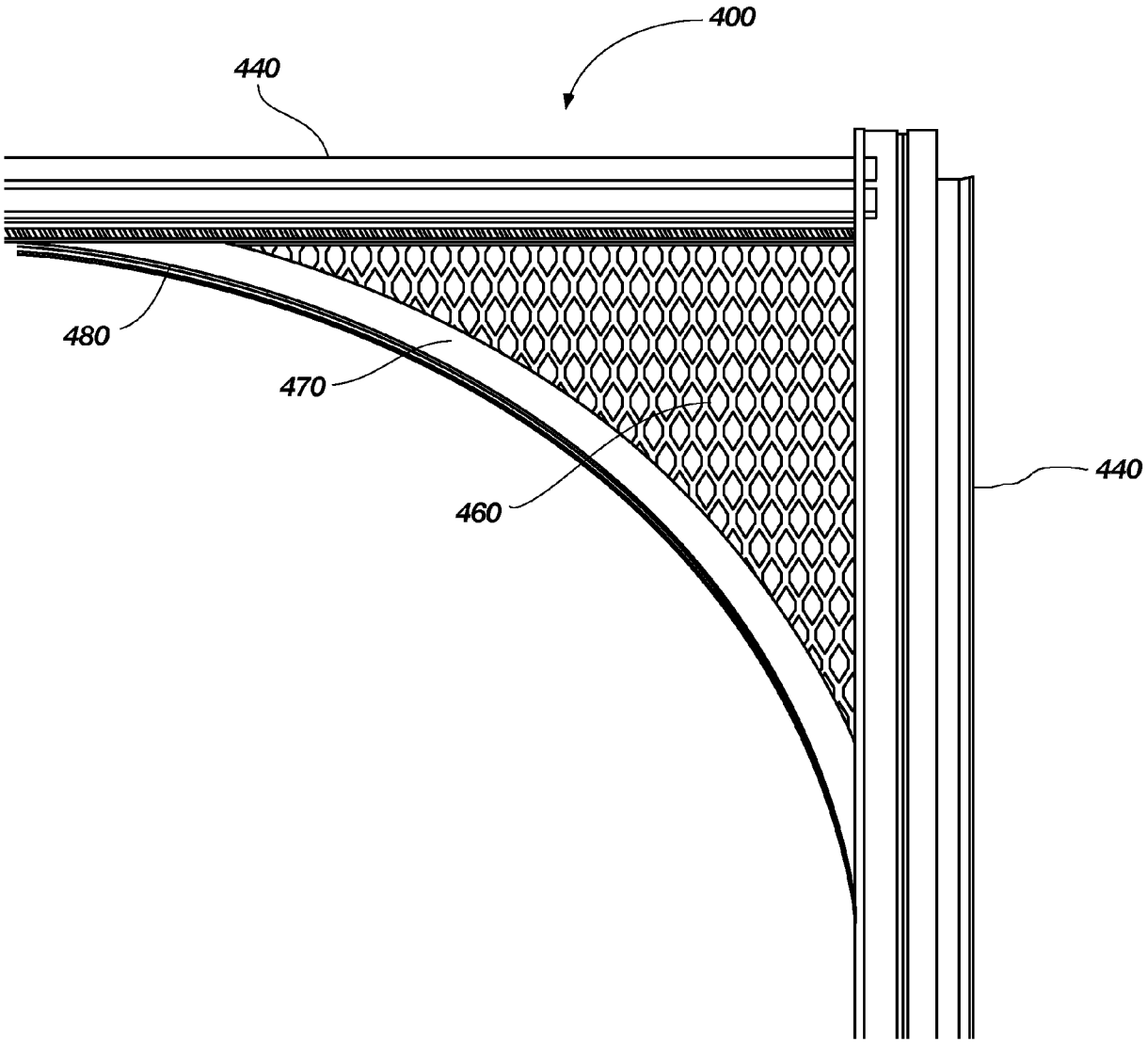
FIG. 7 is a view of an exemplary embodiment of a corner piece in mesh and other components.
Figure 8:
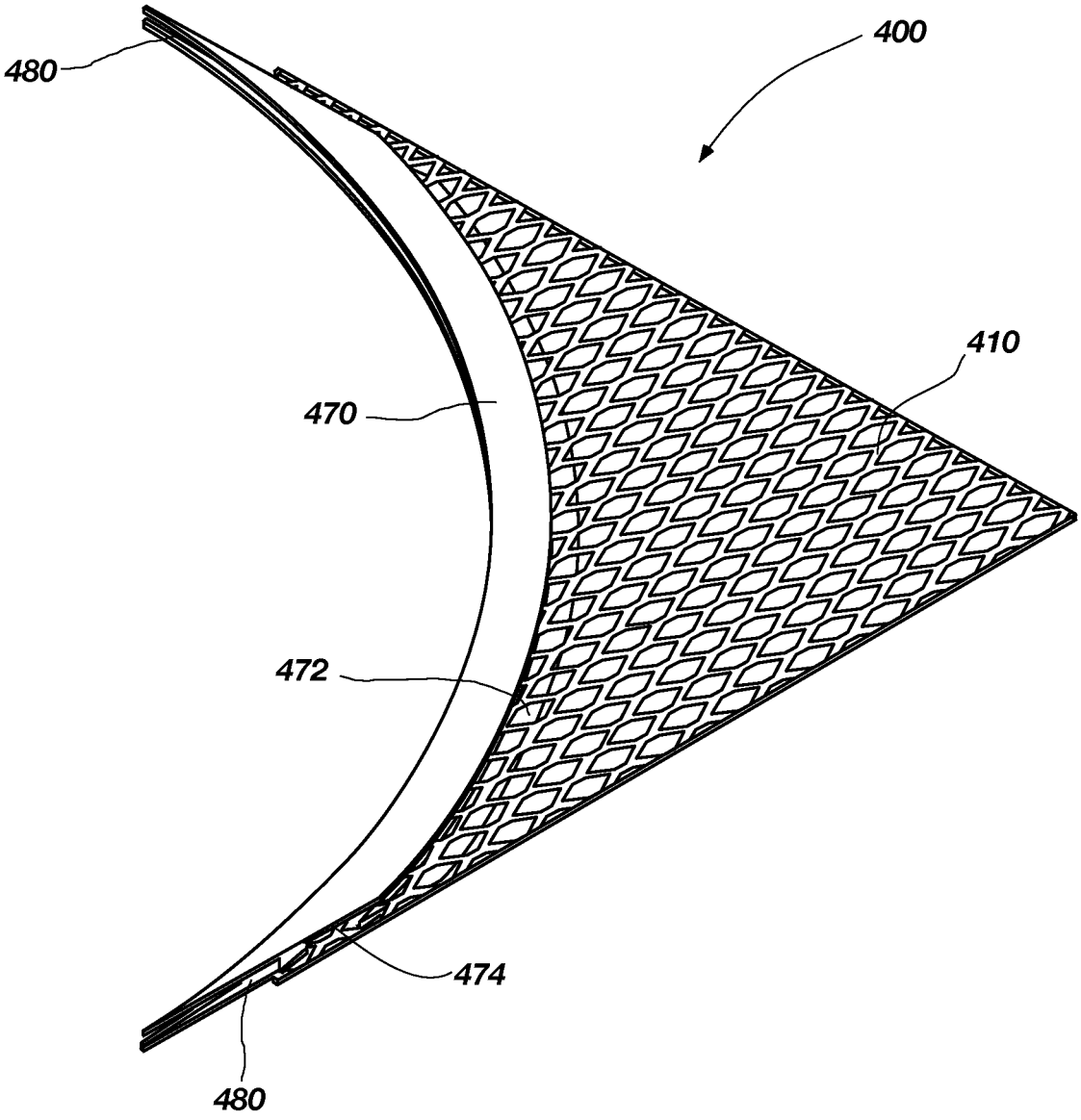
FIG. 8 is a view of an exemplary embodiment of a corner piece in mesh and other components.

Referring now to FIG. 7 and FIG. 8, an exemplary embodiment of the corner 400 is shown. The corner 400 may include two lengths of coping 440 which may meet to form a corner of a pool 400. The corner 400 may be constructed of a mesh material corner piece 410. The mesh material 410 of corner piece may be rigid or it may be flexible. It is within the scope of this application to include the use of tabs as well as a flange along with any suitable protrusion structure. It is within the scope of this application include a groove or fold in place of a slot for accepting a mesh corner material. The liner receptor piece 470 may include a liner receptor slot 480 for receiving and holding a pool liner. Methods of forming a liner receptor piece 470, and liner receptor slot 480, such as bending, cutting, casting, molding, forging, etc. are within the scope of the patent. In an embodiment, the corner is a ninety degree corner, however it will be appreciated that other angular relationships for pool corners conform to, and are contemplated within, the scope of the patent, including, but not limited to, a corner defining any angle greater than zero degrees or less than 180 degrees are contemplated by, the scope of the patent. The liner receptor piece 470 may include a liner receptor slot 480 for receiving and holding a pool liner. Methods of forming a liner receptor piece 470, and liner receptor slot 480, such as bending, cutting, casting, molding, forging, etc. are within the scope of the patent. The mesh portion may be formed in a piece that has an initial area that is smaller than the final area as applied in the pool. The mesh corner may be perforated while in the smaller area configuration and then pulled latterly in tension to open the perforation and resulting in an overall larger area having openings therein. The meshed corner piece 460 may be rounded having an infinite number of angle transitions that sum to approximately the same angle as the corner 400. The meshed corner piece 460 may be angular having a fixed number of angle transitions that sum to approximately the same angle as the corner 400.

Figure 9:
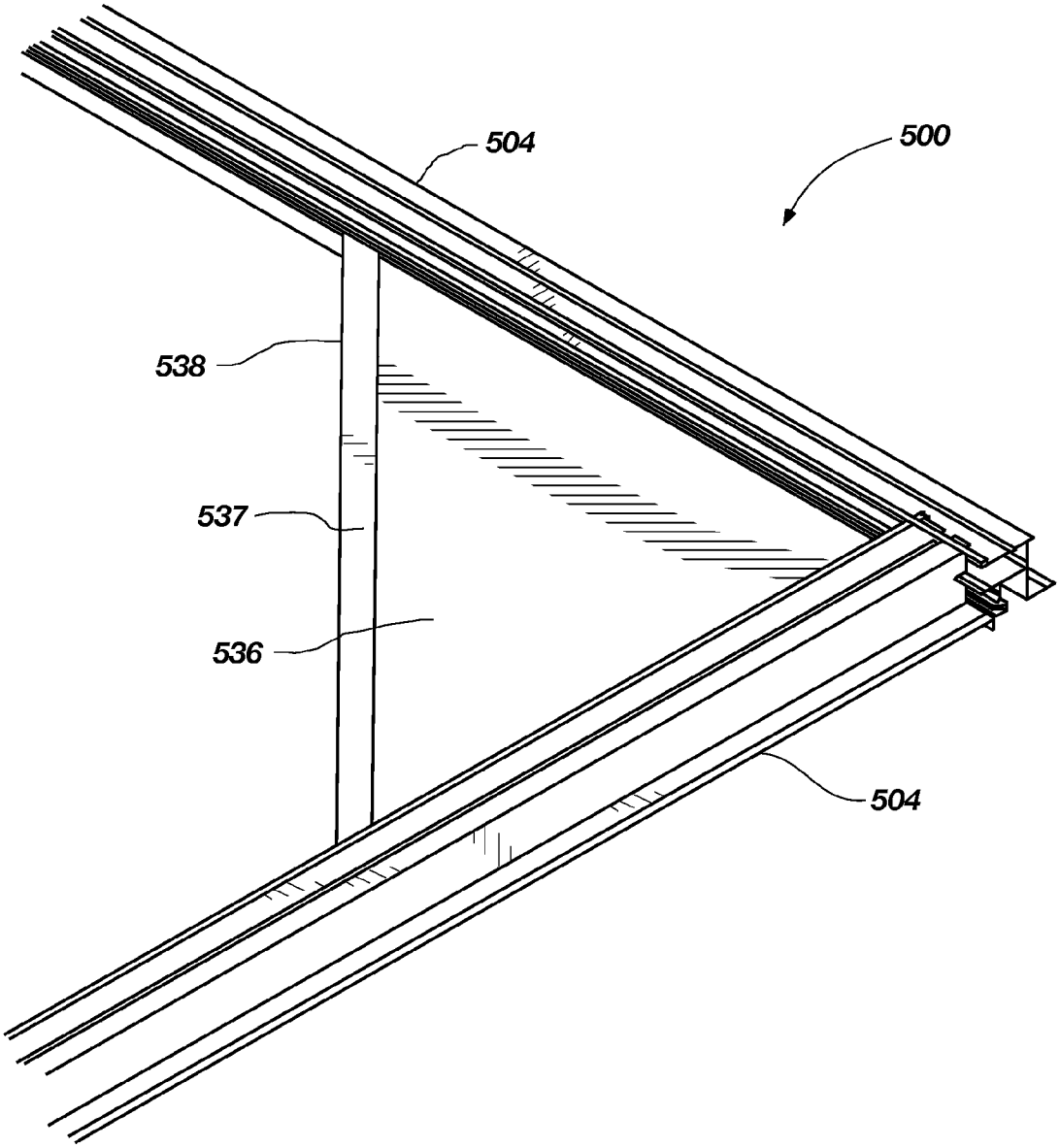
FIG. 9. is a view of an exemplary embodiment of a corner piece and other components.

Referring now to FIG. 9, a view of an exemplary embodiment of the corner 500 is shown. The corner 500 may include a two lengths of coping 504 which may meet to form a corner of a pool. In an embodiment, the corner is a ninety degree corner, however it will be appreciated that other angular relationships for pool corners conform to, and are contemplated by, the scope of the patent. The corner 500 also may include a two part corner piece 536 for providing a transitional angle in the pool corner 500 between coping lengths 504. A liner receptor piece 537 may be configured to accept corner plate 536. Liner receptor portion 537 may comprise a liner receptor slot 538.

Figure 10:
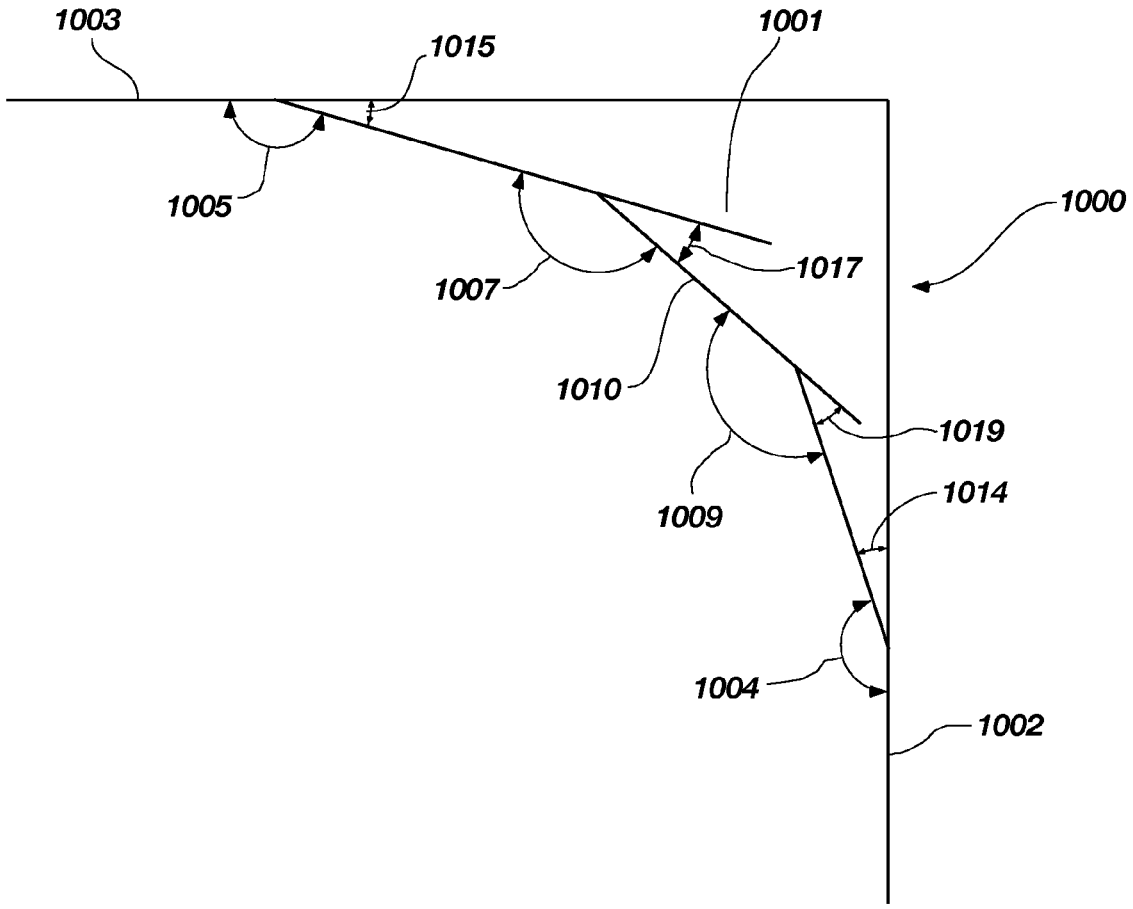
FIG. 10. is a view of an exemplary embodiment of an angled corner piece having four transitional angles and other components.

Referring now to FIG. 10 an embodiment of an angular transitional corner piece will be discussed. In an embodiment four transitional angles may be used for a corner piece 1000. The corner 1000 may include two lengths of coping 1002, 1003 which may meet to form a corner 1000 of a pool. In the embodiment, the corner is a ninety degree corner, however it will be appreciated that other angular relationships for pool corners conform to, and are contemplated within the scope of the patent. The transitional angles are a plurality of angles, and each of the plurality of angles corresponds to an acute angle as known to those of ordinary skill in geometry, and wherein a sum of said corresponding acute angles equals approximately ninety degrees or the angle of the pool corner. Each plurality of angles may have a first and a second angle on either side of either (i) an intermediate single acute angle or (ii) a plurality of intermediate acute angles.

As illustrated corner piece 1001 provides a four angle transition of the liner receptor portion 1010 in the 90 degree corner 1000. For example an embodiment of a pool may have four equal corresponding acute angles of 22.5 degrees that correspond to angles 1004, 1005, 1007, 1009. Angles 1014 and 1015 are complementary to angles 1004 and 1005 respectively. Angles 1017 and 1019 are complementary to angles 1007 and 1009 respectively. Other angular configurations are within the scope of this disclosure. It should be noted that the complementary angles 1014, 1015 between the coping members and the corner piece are most likely to be acute angles when measured to complement the first and last transitional angles in order to provide a smooth transition for the liner receptor slot therein.

In other words a corner piece for forming a corner of a pool may comprise a first and second substantially linear portion having projected tangent lines of said first portion that intersect with a projected tangent line of said second portion at an angle. For example, as observed in FIG. 4, the corner piece 310 may comprise a first substantially linear portion 310*a* and a second substantially linear portion 310*b*. The line 317 may represent a projected tangent line of the first portion 310*a*, in addition to that of the coping 312, and the line 315 may represent a projected tangent line of the second portion 310*b*, in addition to that of the coping 314. The angle α may represent the angle between the projected tangent line 317 and the projected tangent line 315. It may also comprise a third portion comprising a liner receptor slot for receiving a pool liner wherein said third portion comprises a non-curved portion therein and wherein a tangential projection off of a first end of said third portion intersects said tangent line of said first portion at a first acute angle. For example, as observed in FIG. 4, the projected tangent line 317 may intersect with the projected tangent line 318*a* of the liner receptor slot of the third portion 318 to form angle θ. Additionally, a tangential projection off of a second end of said third portion intersects said tangent line of said second portion at a second acute angle.

For example, as observed in FIG. 4, the projected tangent line 315 may intersect with the projected tangent line 318*a* of the liner receptor slot of the third portion 318 to form angle λ. Furthermore, the third portion may comprise an angle corresponding to an acute angle therein forming a concaved form. Another embodiment may be a corner piece having a third portion that comprises a plurality of angles corresponding to a plurality of acute angles thereby forming a concaved form.

Figure 11:
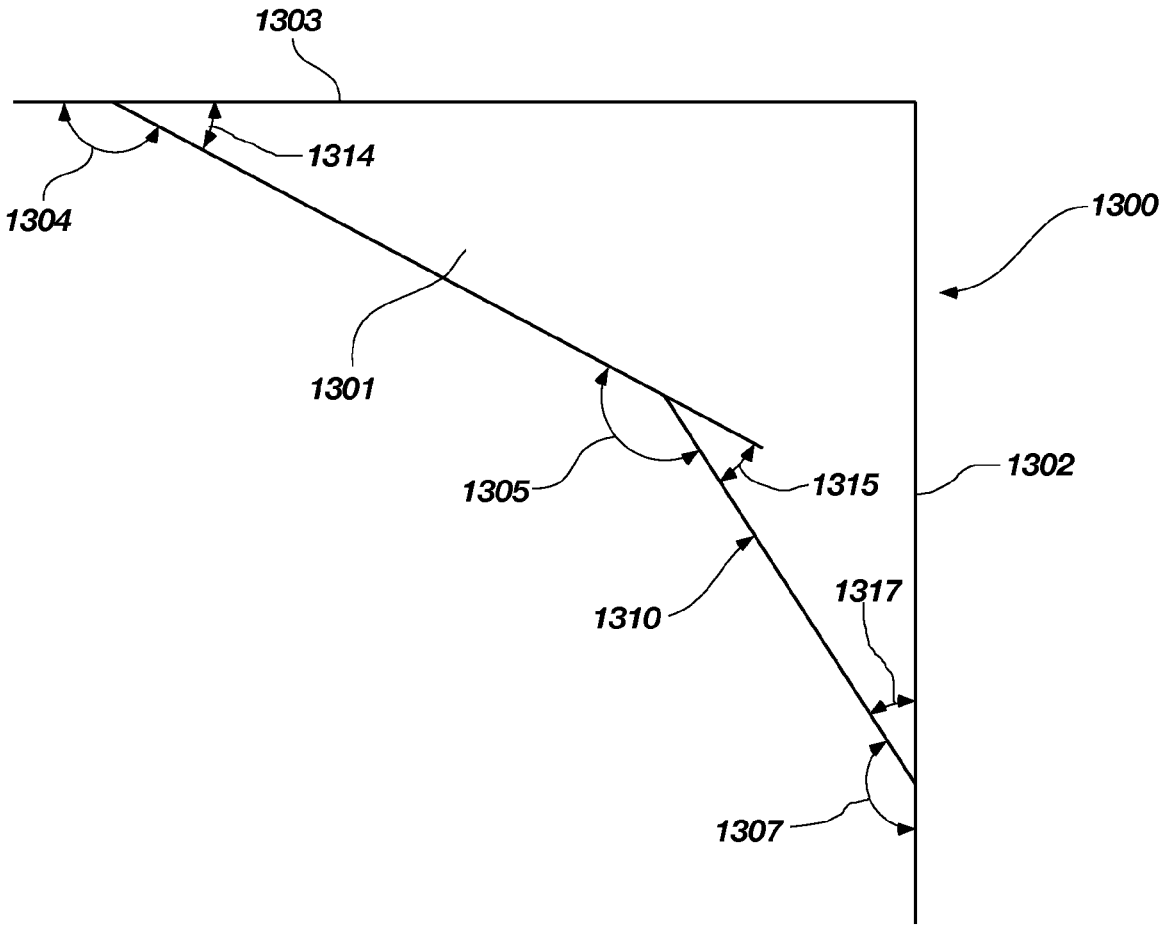
FIG. 11. is a view of an exemplary embodiment of an angled corner piece having three transitional angles and other components.

Referring now to FIG. 11 an embodiment of an angular transitional corner piece will be discussed. In an embodiment, three transitional angles may be used for a corner piece 1310. The corner 1300 may include two lengths of coping 1302, 1303 which may meet to form a corner 1300 of a pool. In the embodiment, the corner is a ninety degree corner, however it will be appreciated that other angular relationships for pool corners conform to, and are contemplated within the scope of the patent. As illustrated corner piece 1301 provides a three angle transition of the liner receptor portion 1310 in the 90 degree corner 1300. For example an embodiment of a pool may have three equal angles 1304, 1305, 1307 of 30 degrees. Angles 1314 and 1317 are complementary to angles 1304 and 1307 respectively. A single intermediate angle 1305 corresponds to complementary angle 1315. Other angular configurations are within the scope of this disclosure. It should be noted that the complementary angles 1314, 1317 between the coping members and the corner piece are most likely to be acute angles when measured to complement the first and last transitional angles in order to provide a smooth transition for the liner receptor slot therein.

Figure 12:
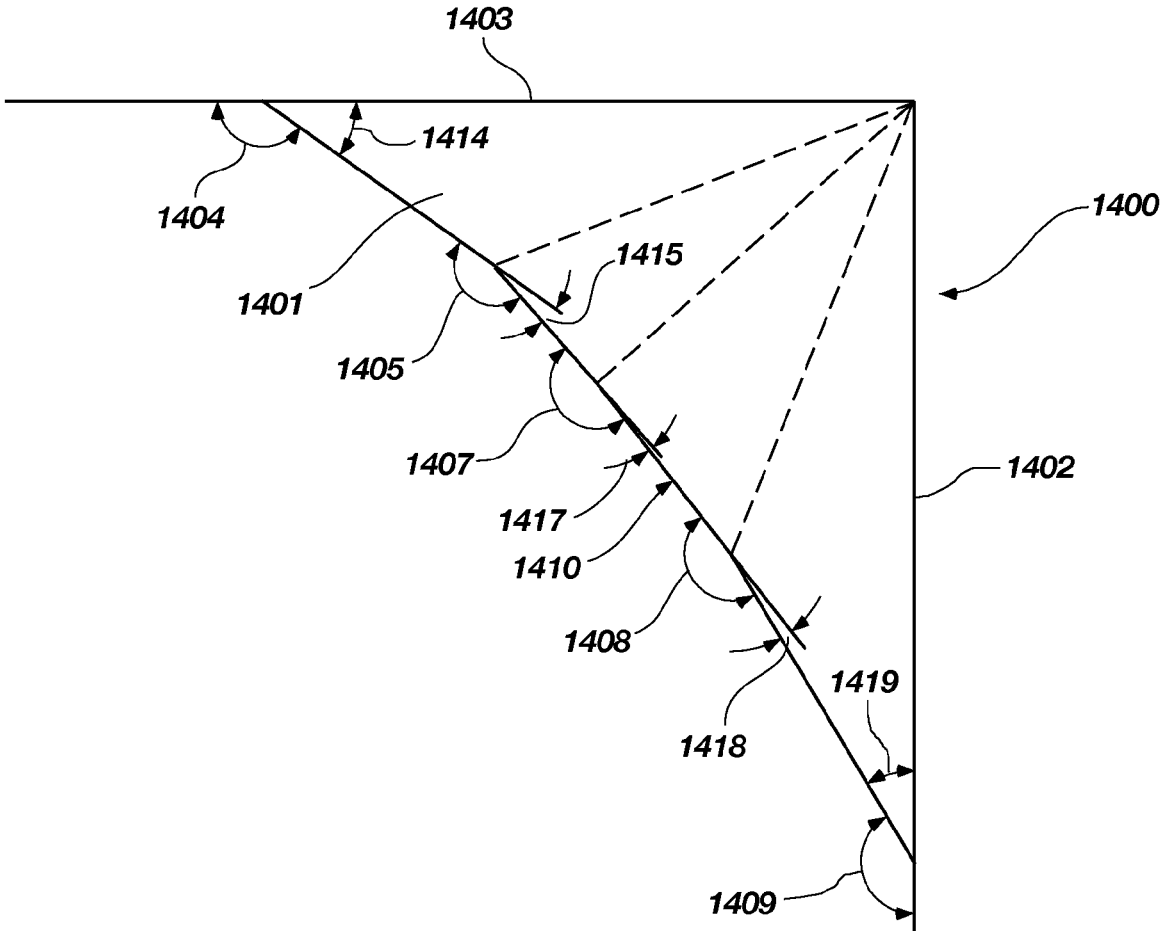
FIG. 12. is a view of an exemplary embodiment of an angled corner piece having five transitional angles and other components.

Referring now to FIG. 12 an embodiment of an angular transitional corner piece will be discussed. In an embodiment, five transitional angles may be used for a corner piece 1401. The corner 1400 may include two lengths of coping 1402, 1403 which may meet to form a corner 1400 of a pool. In the embodiment, the corner is a ninety degree corner, however it will be appreciated that other angular relationships for pool corners conform to, and are contemplated within the scope of the patent. As illustrated, corner piece 1401 provides a five angle transition of the liner receptor portion 1410 in the 90 degree corner 1400. For example an embodiment of a corner may have five equal corresponding angles 1414, 1415, 1417, 1418, 1419 of 18 degrees that correspond to angles 1404, 1405, 1407, 1408, 1409. Angles 1014 and 1015 are complementary to angles 1004 and 1005 respectively. Angles 1414 and 1419 are complementary to angles 1404 and 1409 respectively, Other angular configurations are within the scope of this disclosure. It should be noted that the complementary angles 1414, 1419 between the coping members and the corner piece are most likely to be acute angles when measured to complement the first and last transitional angles in order to provide a smooth transition for the liner receptor slot therein. As discussed above with reference to FIG. 6 above, and number of angle transitions can be made. An embodiment may also have a corner piece of wherein said plurality of intermediate angles when summed with the first and second acute angles equals more than one-hundred an eighty degrees.

An embodiment of the corner piece wherein said corner piece is derived from a first member having a first member angle, and second member having a second member angle, and wherein said first member angle and said second member angle when summed with said first acute angle and second acute angle equal approximately ninety degrees.

An embodiment of the corner piece may have a corner piece that may be derived from a plurality of members having a plurality of member angles, wherein when said plurality of member angles when summed with said first acute angle and second acute angle equal approximately ninety degrees.

Figure 13:
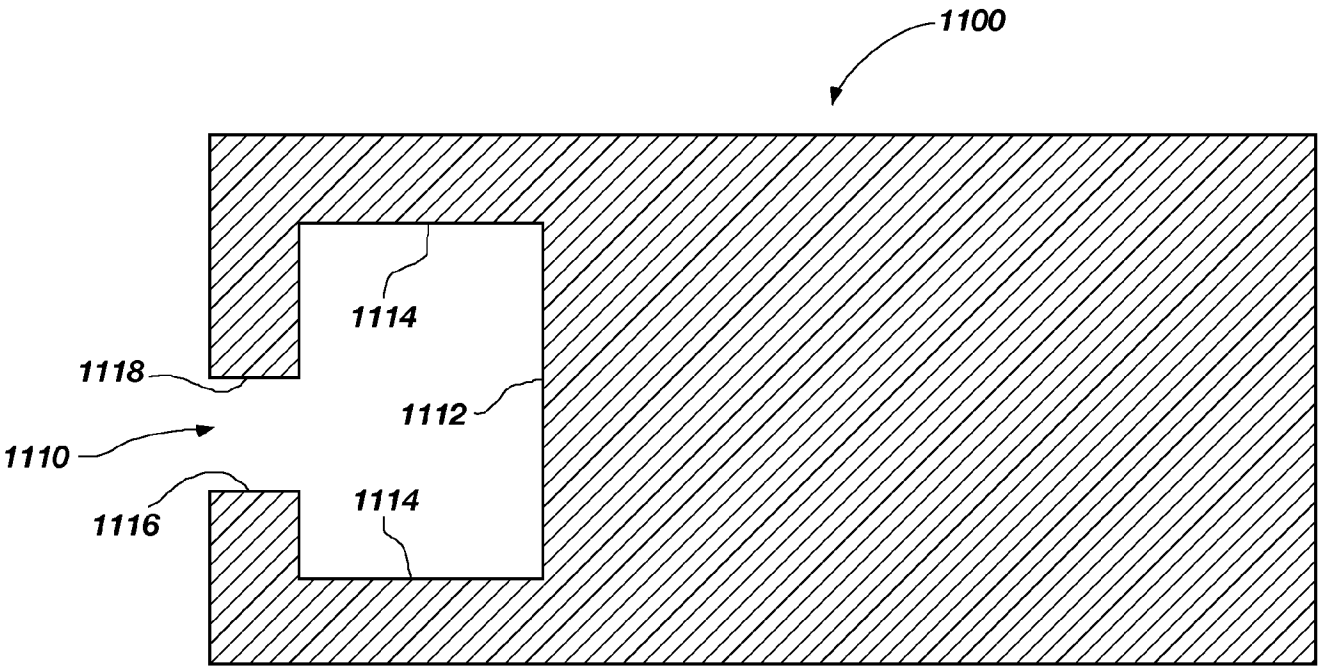
FIG. 13. is a cross-sectional view of an exemplary embodiment of a corner piece retainer lip.

Embodiments of the above mentioned liner receptor slots will now be discussed. With reference to FIG. 13 an embodiment of a liner receptor slot 1100 will be discussed. A liner edge configured to correspond to an applicable liner receptor is illustrated as slot 1110. The liner receptor lips 1116 and 1118 may provide mechanical resistance to prevent the liner edge from moving out of the liner receptor slot 1110. The present embodiment depicts a liner receptor slot 1110 that has a square cross section wherein the vertical wall 1112 is the same length as the horizontal walls 1114. The liner receptor slot 1110 may be configured to allow the insertion of a pool liner and then retain the inserted liner portion therein. The present embodiment depicts a liner receptor slot 1110 that has a rectangular cross section wherein the vertical wall 1112 is longer then the horizontal walls 1114. It is within the scope of the application to include embodiments of liner receptor lips that may be off set to provide additional advantages.

Figure 14:
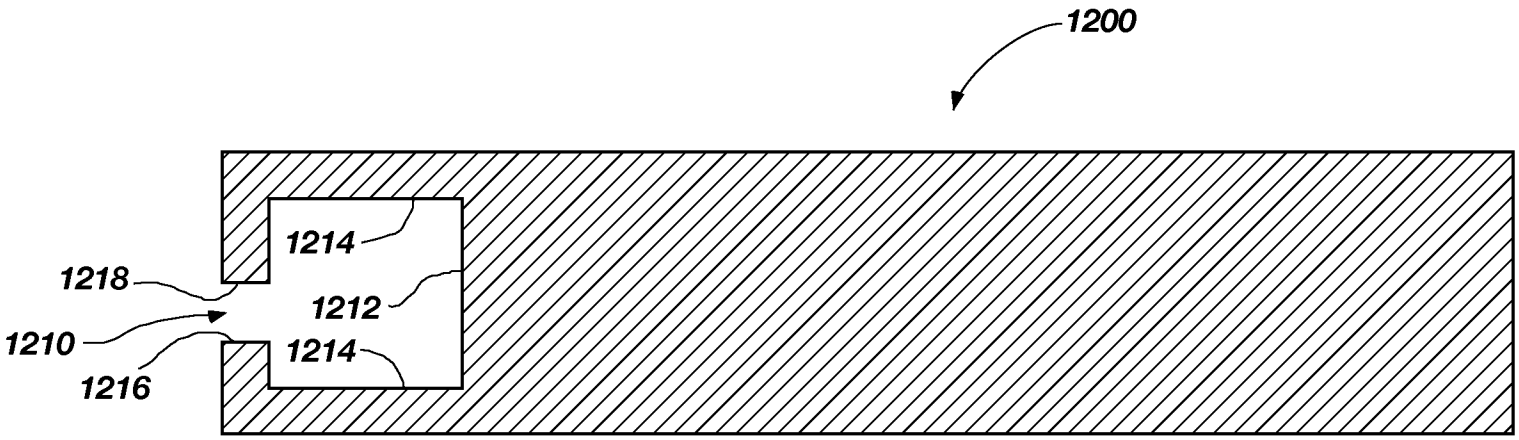
FIG. 14. is a cross-sectional view of an exemplary embodiment of a corner piece retainer lip.

With reference to FIG. 14 an embodiment of a liner receptor slot will be described. Liner receptor portion 1200 includes a liner receptor slot 1210 formed therein. The present embodiment depicts a liner receptor slot 1210 that has a square cross section wherein the vertical wall 1212 is the same length as the horizontal walls 1214. A liner edge configured to correspond to an applicable liner receptor is inserted in to the liner receptor slot 1210. The liner receptor lips 1216 and 1218 provide mechanical resistance to the liner edge from moving out of the liner receptor slot 1210. It is within the scope of the application to include embodiments of liner receptor lips that may be off set to provide advantages.

Figure 15:
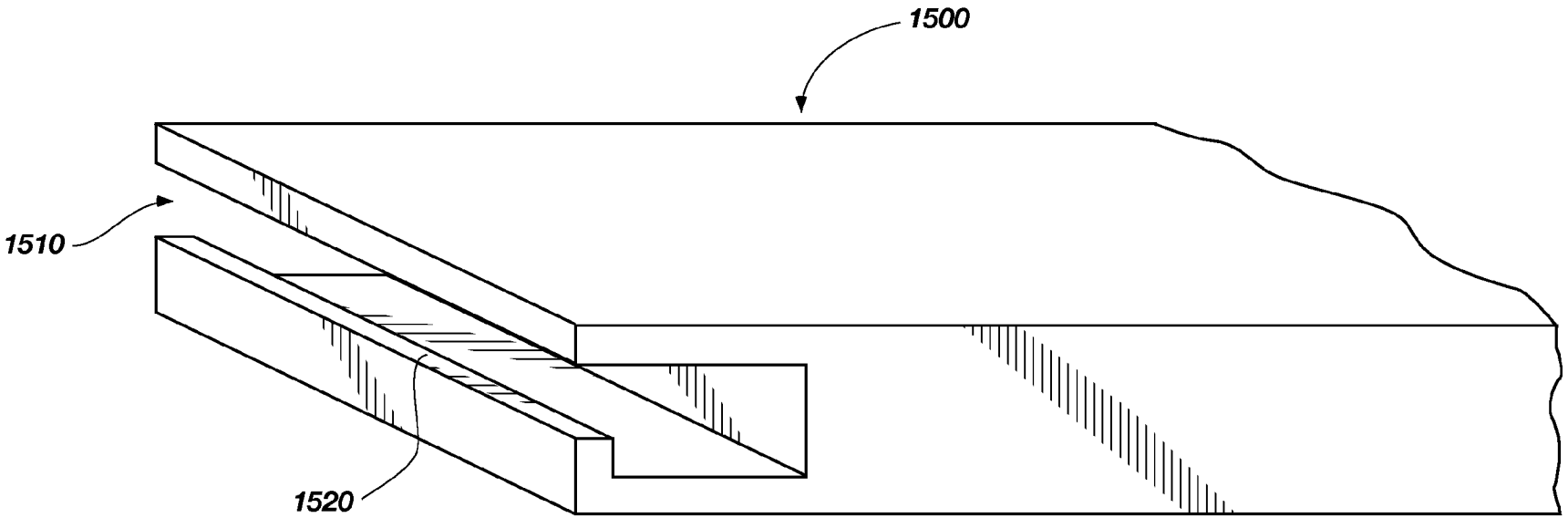
FIG. 15. is a cross-sectional view of an exemplary embodiment of a corner piece retainer lip.

With reference to FIG. 15 an embodiment of a liner receptor slot will be described. Liner receptor portion 1500 includes a liner receptor slot 1510 formed therein. A liner edge configured to correspond to an applicable liner receptor is inserted in to the liner receptor slot 1510. The single liner receptor lip 1520 may provide mechanical resistance to the liner edge to prevent it from moving out of the liner receptor slot 1510. It is within the scope of the application to include embodiments of liner receptor lips that may be formed at the top or bottom of the liner receptor slot 1510.

Figure 16:
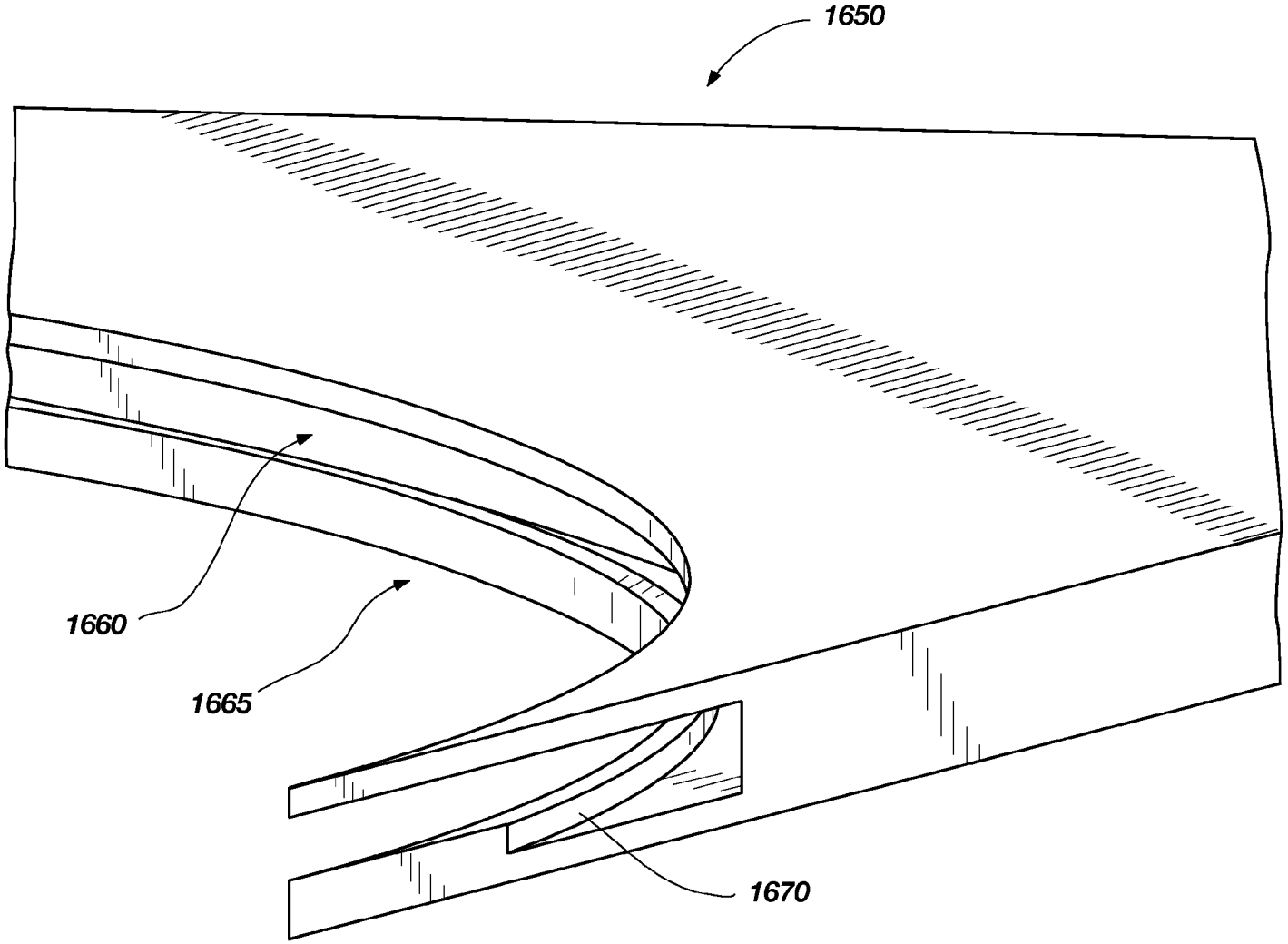
FIG. 16. is a view of an exemplary embodiment of a corner piece.

With reference to FIG. 16 an embodiment of a liner receptor slot cut into a solid single piece corner piece will be described. A solid single piece of material 1650 may have a liner receptor slot 1660 cut into a curved or angled receptor portion 1665. This embodiment demonstrates the feature of a single liner receptor lip 1670 for retaining an inserted pool liner edge. It is within the scope of the application to include embodiments of liner receptor lips that may be formed at the top or bottom of the liner receptor slot 1660.

Figure 17:
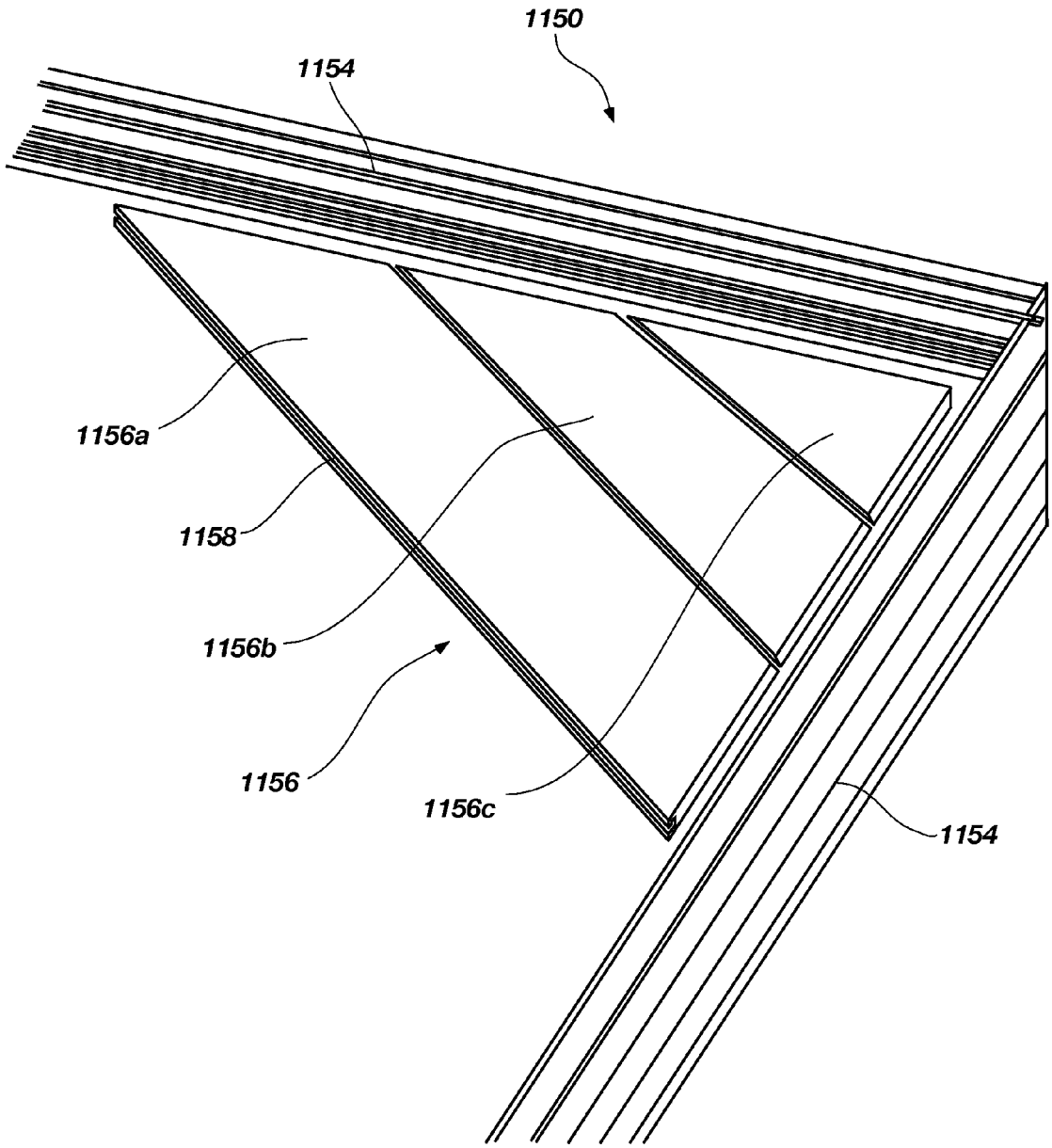
FIG. 17. is a view of an exemplary embodiment of a corner piece and other components.

Referring now to FIG. 17, a view of an exemplary embodiment of the corner 1150 is shown. The corner 1150 may include two lengths of coping 1154 which may meet to form a corner of a pool. In the embodiment, the corner is a ninety degree corner, however it will be appreciated that other angular relationships for pool corners conform to, and are contemplated within the scope of the patent.

It is within the scope of this application to include any number of pieces to complete a corner. The pieces 1156*a*, 1156*b*, 1156*c* forming the corner plate 1156 may be cut or milled from stock material as a single piece unit. Liner receptor slot 1158 may be milled or cut from the single piece of material 1156*a*. Other methods of forming the multiple pieces such as casting, molding, forging, etc. are within the scope of the patent.

Figure 18:
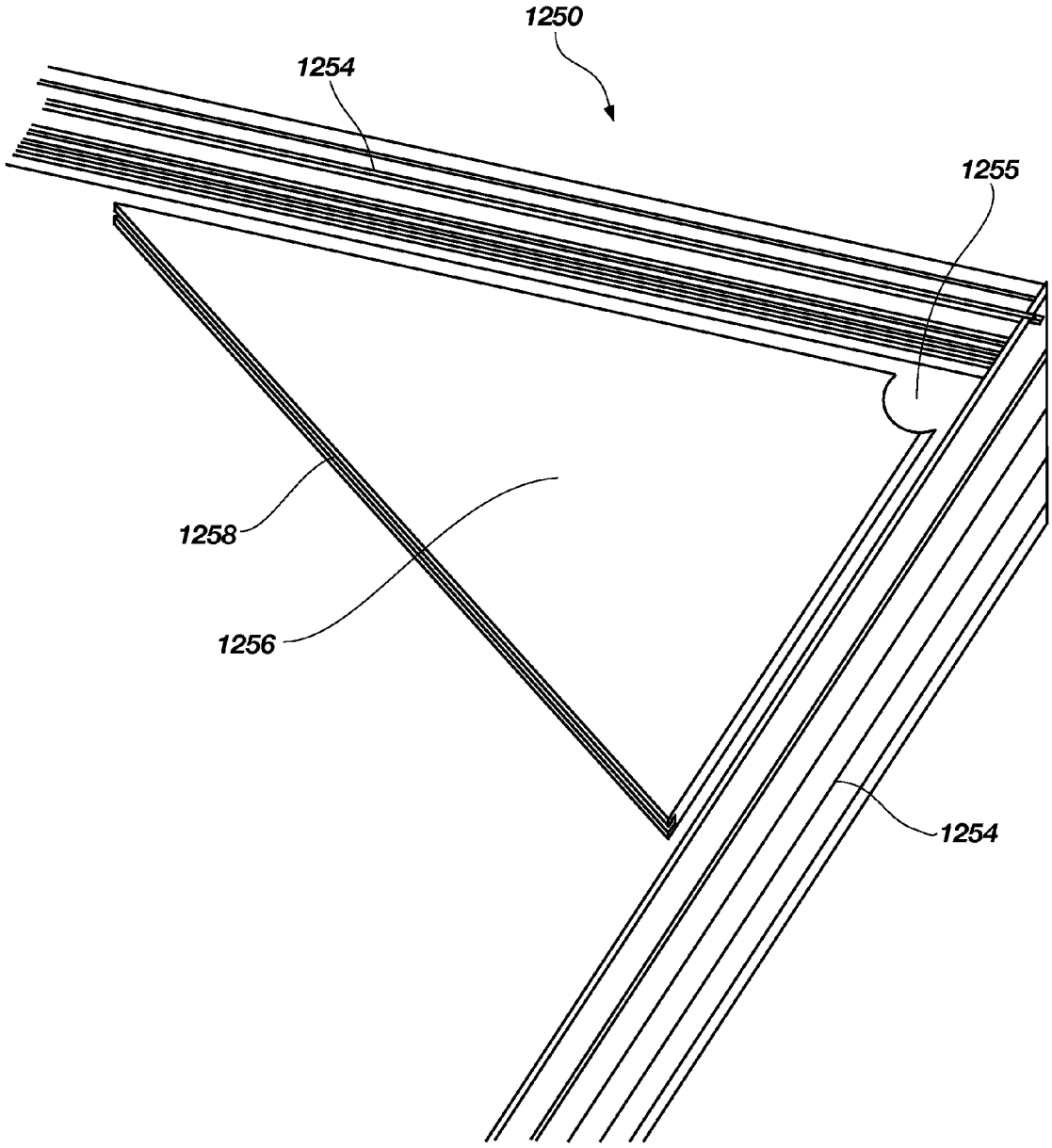
FIG. 18. is a view of an exemplary embodiment of a corner piece with drainage and other components.

Referring now to FIG. 18, a view of an exemplary embodiment of the corner 1250 is shown. The corner 1200 may include two lengths of coping 1254 which may meet to form a corner of a pool. In the embodiment, the corner is a ninety degree corner, however it will be appreciated that other angular relationships for pool corners conform to, and are contemplated within the scope of the patent. The corner plate may also include a drainage opening 1255 for allowing water to drain from the corner rather than to sit and possibly corrode the pool corner material or leave unsightly residue after evaporating. An edge may be configured with a liner receptor portion 1258. It is within the scope of this application to include any number of drainage opening with any type of placement. The drainage opening may be of any shape or size suitable for draining water. The drainage opening may be incidental and result from another intended purpose such as a hole made for fastening but that in application is left open. The corner plate 1256 may be cut or milled from stock material as a single piece unit. Liner receptor slot 1258 may be milled or cut. Other methods of forming the corner plate 1256 with a drainage hole 1255 such as casting, molding, forging, etc. are within the scope of the patent.

Figure 19:
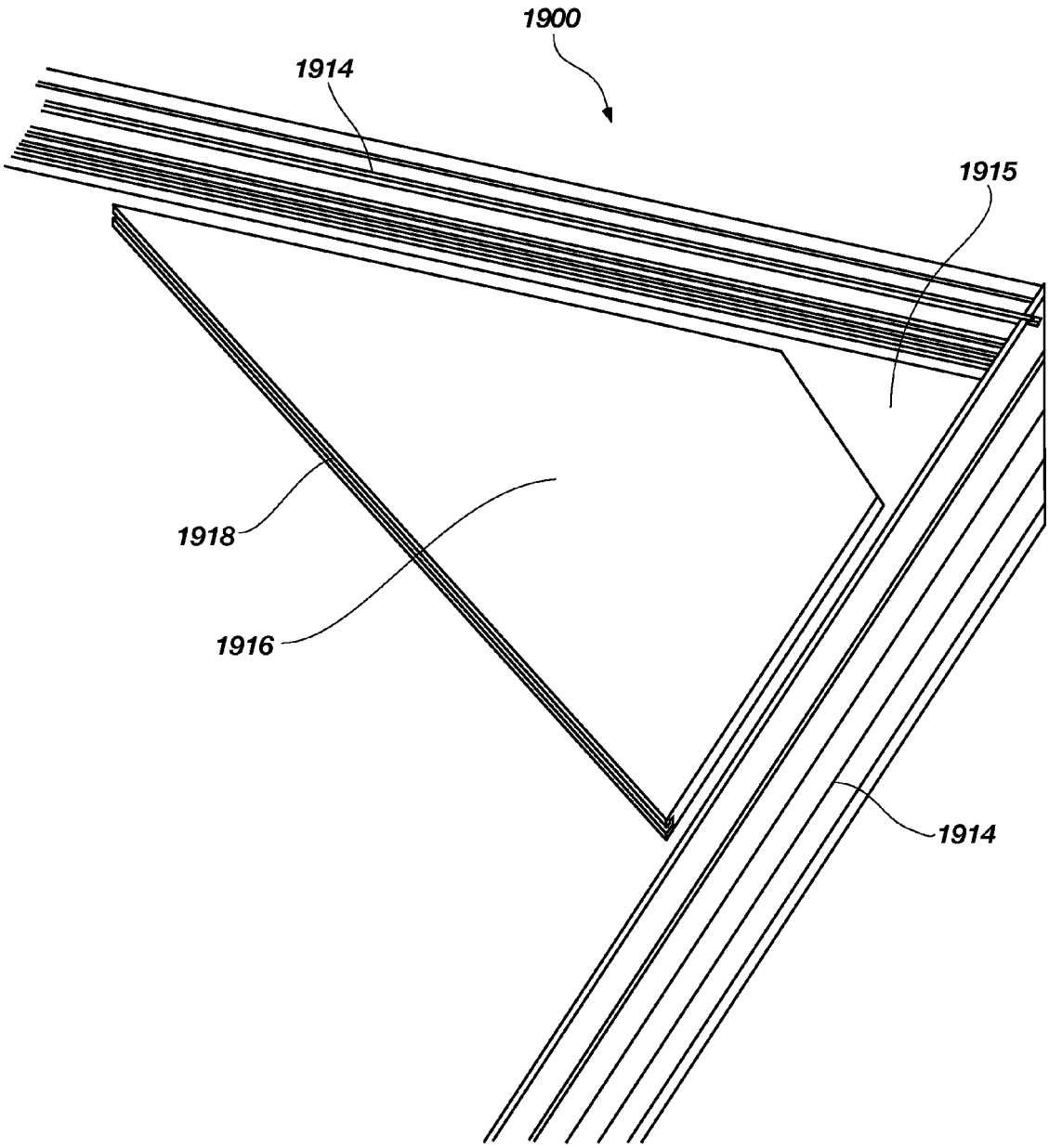
FIG. 19. is a view of an exemplary embodiment of a corner piece with drainage and other components.

Referring now to FIG. 19, a view of an exemplary embodiment of the corner 1900 is shown. The corner 1900 may include two lengths of coping 1914 which may meet to form a corner of a pool. In the embodiment, the corner is a ninety degree corner, however it will be appreciated that other angular relationships for pool corners conform to, and are contemplated within the scope of the patent. The corner plate 1916 may also include a beveled corner 1915 providing an opening for allowing water to drain from the corner rather than to sit and possibly corrode the pool corner material or leave unsightly residue after evaporating. An edge may be configured with a liner receptor portion 1918. The drainage opening may be of any shape or size suitable for draining water. The drainage opening may be incidental and result from another intended purpose such as a structure for fastening an additional member. The corner plate 1916 may be cut or milled from stock material as a single piece unit. Liner receptor slot 1918 may be milled or cut. Other methods of forming the corner plate 1916 with a drainage opening 1915 such as casting, molding, forging, etc. are within the scope of the patent.

Figure 20:
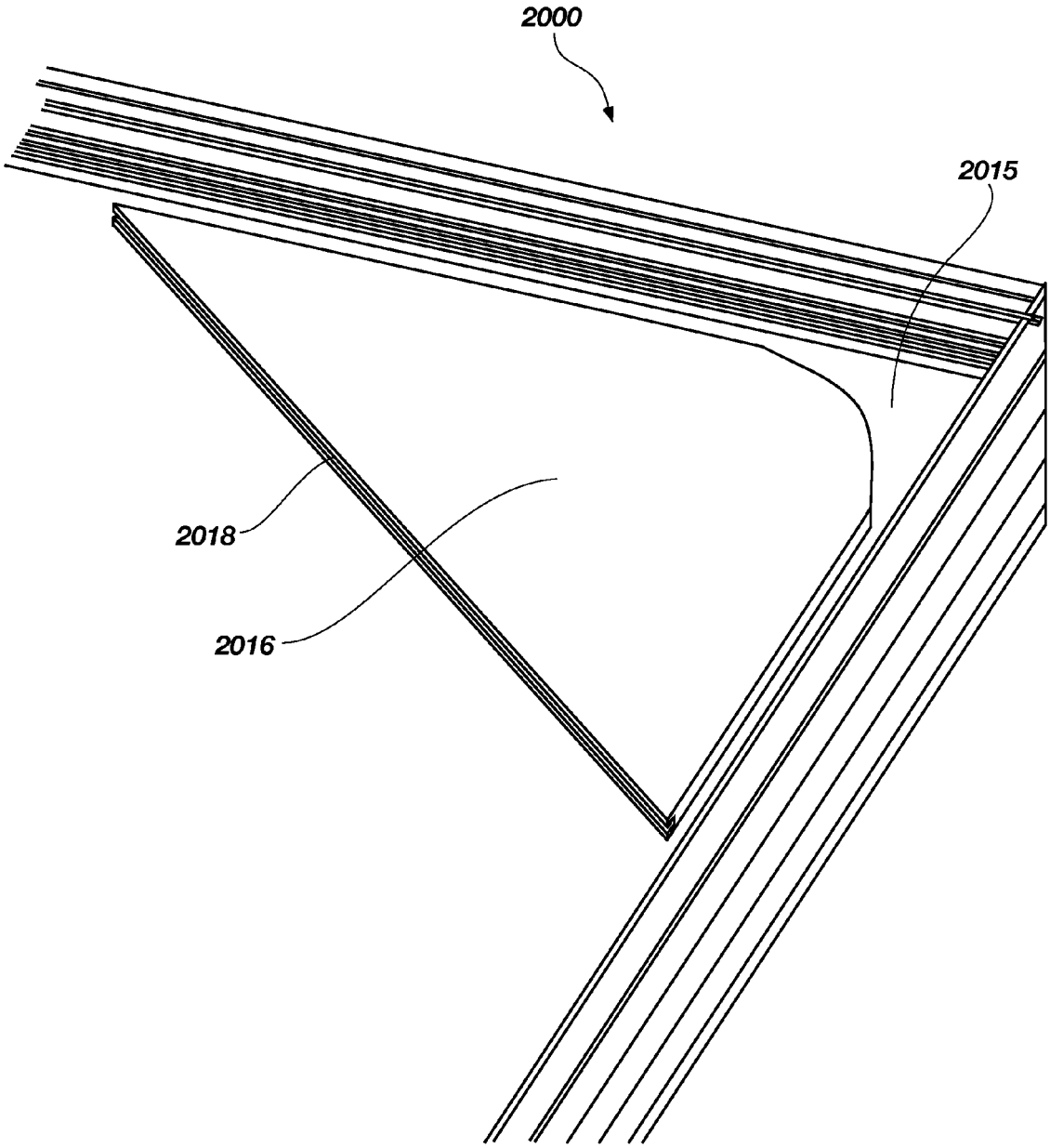
FIG. 20. is a view of an exemplary embodiment of a corner piece with drainage and other components.

Referring now to FIG. 20, a view of an exemplary embodiment of the corner 2000 is shown. An edge may be configured with a liner receptor portion 2018. The drainage opening 2015 may be of any shape or size suitable for draining water. The drainage opening may be incidental and result from another intended purpose such as a structure for fastening an additional member. The corner plate 2016 may be cut or milled from stock material as a single piece unit. Liner receptor slot 2018 may be milled or cut. Other methods of forming the corner plate 2016 with a drainage opening 2015 such as casting, molding, forging, etc. are within the scope of the patent.

Figure 21:
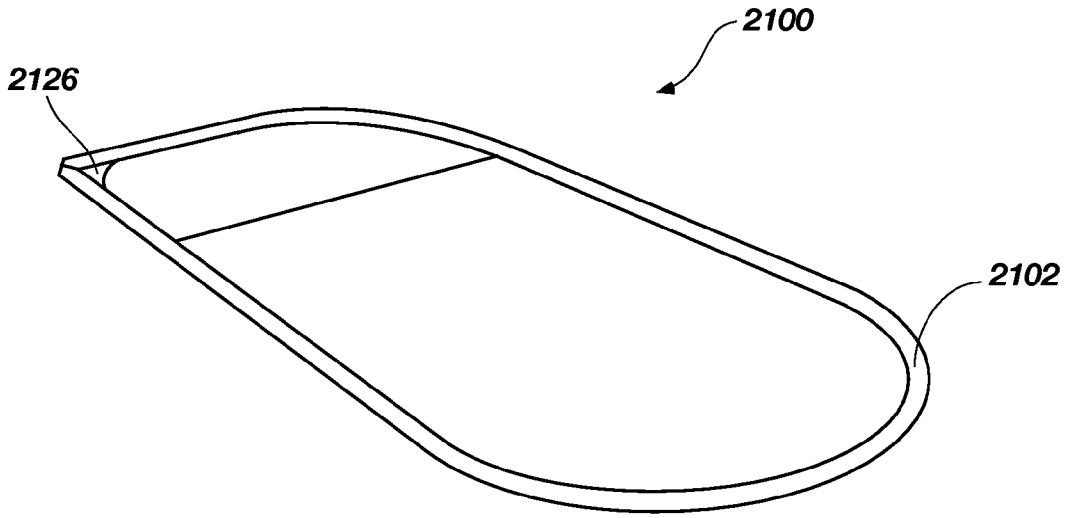
FIG. 21. is a view of an exemplary embodiment of a pool having a corner piece.

Referring now to FIG. 21, a view of an exemplary embodiment of the single corner pool assembly 2100 is shown. The corner 2126 may be configured to interface with a length of coping 2102 which may be used to form a boarder of a pool. In an embodiment, the corner is a ninety degree corner, however it will be appreciated that other angular relationships for pool corners conform to, and are contemplated by, the scope of the patent. The corner assembly 2100 may comprise two pieces. A first piece may be a generally plainer corner plate 2126 for providing a transitional curve or radius in the pool corner between coping lengths. In other words, a transitional curve may be considered a curve that provides a rounded transitional path between the lengths of coping an initial angle and the resultant angle. For example, if a pool corner has a 90 degree corner between coping lengths, a continuous curve transition would represent an infinite number of angles that when combined would equal 90 degrees. It is within the scope of this application to include any number of incremental and random angle transitions to complete a corner. The corner plate 2126 having a top side and a bottom side. The corner plate 2126 may have a face and generally linear sides, bounding the plate that generally come together or tangentially come together forming a bounding intersection and not necessarily a point. Corner plate 2126 may include a liner receptor slot for receiving and holding a pool liner. The liner receptor slot may be part of a single piece of material corner plate, or may be cut or milled from stock material as a separate piece receptor portion. If formed from a separate piece, the receptor portion may take the form of a "C" channel that is then mounted to the corner plate 2126.

Figure 22A:
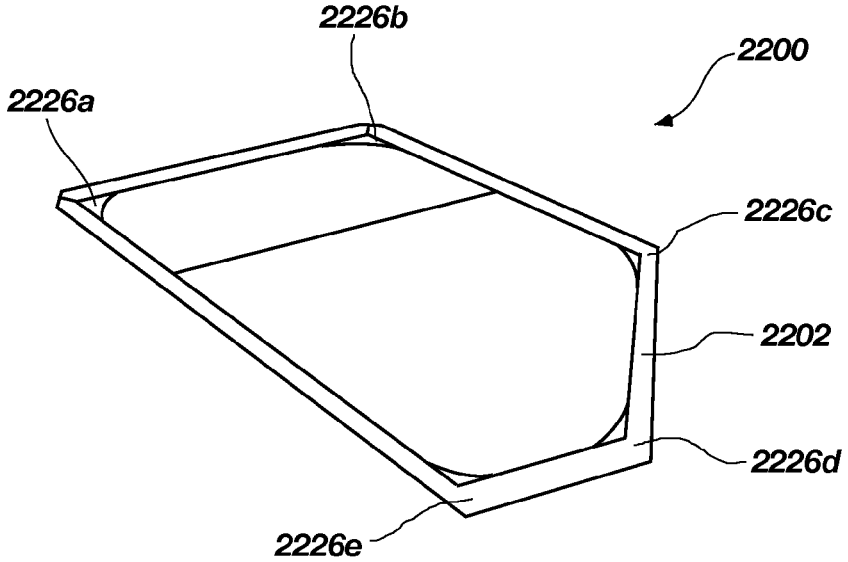
FIG. 22*a*. is a view of an exemplary embodiment of a pool having a plurality of corner pieces and other components.
Figure 22B:
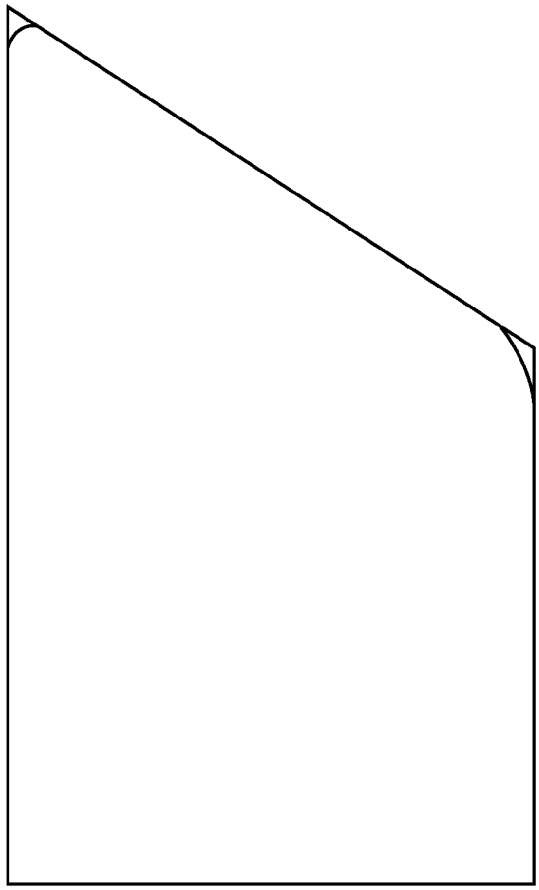
FIG. 22*b*. is a view of an exemplary embodiment of a pool having a plurality of corner pieces and other components.
Figure 23:
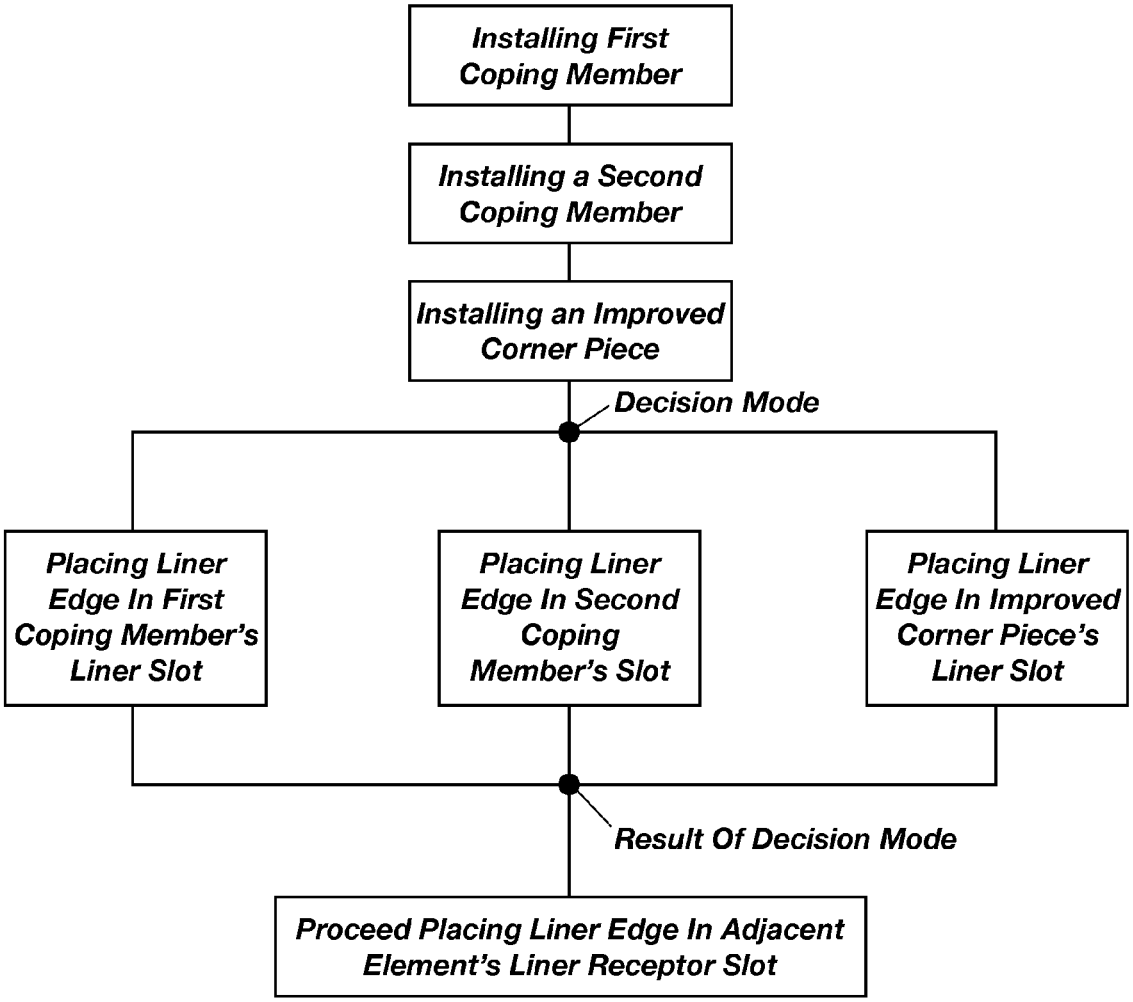
FIG. 23. illustrates a method of using a corner piece in constructing a pool.
Figure 24:
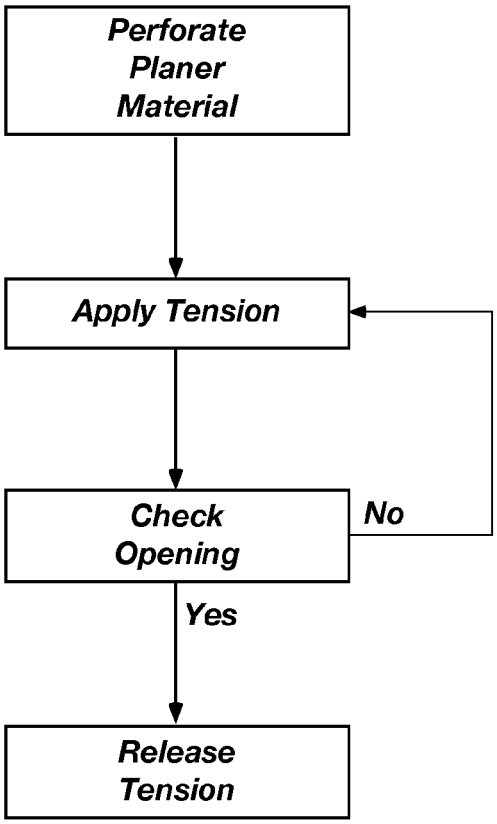
FIG. 24. illustrates a method of making a corner piece.

Referring now to FIG. 22*a*, a view of an exemplary embodiment of a five corner pool assembly 2200 is shown. The corners 2226*a*, 2226*b*, 2226*c*, 2226*d*, 2226*e* may be configured to interface with lengths of coping 2202 which may be used to form a boarder of a pool. In this embodiment, the corners are differing in angles, and it will be appreciated that differing corner pieces may be employed for the differing angles. The pool assembly 2200 may comprise two components. A first piece may be a generally plainer corner plate 2226 for providing a transitional curve or radius in the pool corner between coping lengths. In other words, a transitional curve may be considered a curve that provides a rounded transitional path between the lengths of coping an initial angle and the resultant angle. The angles of the five corners when combined would equal 360 degrees. It is within the scope of this application to include any number of incremental and random angle transitions to complete a corner.

Referring now to FIG. 22*a* a pool having a corner of less than 90 degrees is illustrated.

An additional embodiment may contain a corner piece for forming a corner of a pool, said corner piece comprising:

a first side shaped as to correspond with and abut to a pool wall near a corner;

a second side shaped as to correspond with and abut to a pool wall near a corner;

wherein a projected tangent line of said first side intersects with a projected tangent line of said second side forming a corner angle; and a third side comprising a liner receptor slot for receiving a pool liner wherein tangential projections or the third side intersects projections of said first and second sides.

In another embodiment a corner piece may further comprise a drainage opening where said projected tangent line of said first side intersects with said projected tangent line of said second side. Additionally, the corner piece may be formed by cutting from a solid piece of stock material, or is formed from two parts; wherein a first part and a second part are joined.

Other exemplary features may be a first part comprising a series of openings and a second part comprises a liner receptor slot.

In view of the foregoing, it will be appreciated that the disclosed a corner, for covering a top of a pool sidewall, which is simple in design and manufacture, and which provides for alignment of the liner slot. The disclosed also provides a corner for a pool which eliminates a visible gap between the corner plate and the pool sidewall, and which provides a finish cover with a aesthetically pleasant appearance.

A pool assembly using an improved corner piece may be installed using the following method. A user may install a first coping member and a second coping member thereby forming at least a corner. The user may then install an improved corner piece. A user would then decide where to start inserting a liner into the liner receptor slot of any of the components thus assembled. After choosing where to begin the user would install the liner around the circumference of the pool, ending at the component that he did not start with in the assembly, but is adjacent thereto.

A method for constructing a perforated corner piece for a pool assembly comprising the following acts. A user would perforate a generally planer piece of substantially ductile material. The user would then apply opposing tension forces in the direction of desired expansion. The user would then observe the condition of the piece. Once the piece has reached a predetermined dimension releasing the tension force.

It is to be understood that the above-described arrangements are only illustrative of the application of the principles of the disclosure. Numerous modifications and alternative arrangements may be devised by those skilled in the art without departing from the spirit and scope of the disclosure. Thus, while the embodiments have been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

It will be appreciated that the structure and apparatus disclosed herein is merely one example of a means for providing a transitional corner for a pool, and it should be appreciated that any structure, apparatus or system for providing a transitional corner for a pool which performs functions the same as, or equivalent to, those disclosed herein are intended to fall within the scope of a means for providing a transitional corner for a pool, including those structures, apparatus or systems for providing a transitional corner for a pool which are presently known, or which may become available in the future. Anything which functions the same as, or equivalently to, a means for providing a transitional corner for a pool falls within the scope of this element.

Those having ordinary skill in the relevant art will appreciate the advantages provide by the features of the present disclosure.

In the foregoing Detailed Description, various features of the present disclosure are grouped together in a single embodiment for the purpose of streamlining the disclosure. For example, an embodiment of a corner piece for forming a corner of a pool well with in the scope of this disclosure may have a first substantially linear portion;

a second substantially linear portion;

wherein a projected tangent line of said first portion intersects with a projected tangent line of said second portion forms an angle;

a third portion comprising a liner receptor slot for receiving a pool liner;

wherein a tangential projection off of an first end of said third portion intersects said tangent line of said first portion at a first acute angle;

wherein a tangential projection off of a second end of said third portion intersects said tangent line of said second portion at a second acute angle;

wherein a sum of said first acute angle and said second acute angle is less than ninety degrees; and wherein said third portion is formed from a plurality of substantially linear segments forming a concaved form; and comprising a plurality of openings. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A corner assembly for forming a corner of a pool, said corner assembly comprising:

a first length of coping and a second length of coping, the first and second lengths of coping meeting to form a pool corner; and a corner piece disposed in said pool corner, said corner piece comprising:

a first portion abutting against said first length of coping, a second portion abutting against said second length of coping, wherein a projected tangent line of said first portion intersects with a projected tangent line of said second portion at an angle, a liner receptor slot for receiving a pool liner wherein said liner receptor slot comprises a non-curved portion, wherein said non-curved portion of the liner receptor slot forms a side of a straight-sided triangle formed by the first portion, the second portion, and the non-curved portion of the liner receptor slot, wherein a projected tangent line off of a first end of said non-curved portion of the liner receptor slot intersects said projected tangent line of said first portion at a first acute angle, and wherein a projected tangent line off of a second end of said non-curved portion of the liner receptor slot intersects said projected tangent line of said second portion at a second acute angle.

2. The corner assembly of claim 1 wherein said first acute angle is 45 degrees.

3. The corner assembly of claim 1 wherein said second acute angle is 45 degrees.

4. The corner assembly of claim 1 wherein said liner receptor slot is substantially linear.

5. The corner assembly of claim 1 wherein said corner piece comprises a planar surface having a plurality of openings.

6. A swimming pool system comprising:

a polymeric pool liner;

a pool corner having a first length of coping and a second length of coping, the first and second lengths of coping meeting to form the pool corner at a corner angle;

a corner piece disposed in said pool corner, said corner piece comprising:

a first substantially linear portion, a second substantially linear portion, wherein a projected tangent line of said first portion intersects with a projected tangent line of said second portion at an angle, and a liner receptor slot for receiving said polymeric pool liner and wherein said liner receptor slot comprises a non-curved portion therein, wherein said non-curved portion of the liner receptor slot forms a side of a straight-sided triangle formed by the first substantially linear portion, the second substantially linear portion, and the non-curved portion of the liner receptor slot;

wherein the non-curved portion of the liner receptor slot extends between, and intersects with, the first length of coping and the second length of coping;

wherein a projected tangent line off of a first end of said non-curved portion of the liner receptor slot intersects said tangent line of said first portion at a first acute angle; and wherein a projected tangent line off of a second end of said non-curved portion of the liner receptor slot intersects said tangent line of said second portion at a second acute angle.

7. The swimming pool system of claim 6 wherein said corner angle is approximately ninety degrees.

8. The swimming pool system of claim 6 wherein said corner angle is greater than ninety degrees.

9. The swimming pool system of claim 6 wherein said corner angle is less than ninety degrees.

10. The swimming pool system of claim 6 having a plurality of corners.

11. A corner assembly for forming a corner of a pool, said corner piece comprising:

a first length of coping and a second length of coping, the first and second lengths of coping meeting to form a pool corner; and a corner piece disposed in said pool corner, said corner piece comprising:

a first substantially linear portion, a second substantially linear portion, wherein a projected tangent line of said first portion intersects with a projected tangent line of said second portion at an angle, a liner receptor slot for receiving a pool liner, wherein said liner receptor slot forms a side of a straight-sided triangle formed by the first substantially linear portion, the second substantially linear portion, and the non-curved portion of the liner receptor slot, wherein a projected tangent line off of a first end of said liner receptor slot intersects said tangent line of said first portion at a first acute angle, wherein a projected tangent line off of a second end of said liner receptor slot intersects said tangent line of said second portion at a second acute angle, and wherein said liner receptor slot is wider than it is deep.

12. A corner assembly for forming a corner of a pool, said corner piece comprising:

a first length of coping and a second length of coping, the first and second lengths of coping meeting to form a pool corner; and a corner piece disposed in said pool corner, said corner piece comprising:

a first substantially linear portion, a second substantially linear portion, wherein a projected tangent line of said first portion intersects with a projected tangent line of said second portion at an angle, a liner receptor slot for receiving a pool liner, wherein said liner receptor slot forms a side of a straight-sided triangle formed by the first substantially linear portion, the second substantially linear portion, and the non-curved portion of the liner receptor slot, wherein a projected tangent line off of a first end of said liner receptor slot intersects said tangent line of said first portion at a first acute angle, wherein a projected tangent line off of a second end of said liner receptor slot intersects said tangent line of said second portion at a second acute angle, and wherein said liner receptor slot comprises at least one lip protrusions.

13. The corner assembly of claim 12 wherein the at least one lip protrusions comprises a plurality of lip protrusions.

14. The corner assembly of claim 13 wherein the plurality of lip protrusions are of equal lengths.

15. The corner assembly of claim 13 wherein the plurality of lip protrusions are of differing dimensions.

* * * * *